US008057413B2

(12) United States Patent
Katsukawa et al.

(10) Patent No.: US 8,057,413 B2
(45) Date of Patent: Nov. 15, 2011

(54) FOOT WATER JETTING DEVICE

(75) Inventors: Yumiko Katsukawa, Kitakyusyu (JP); Takahiro Suzuki, Kitakyusyu (JP); Hirotomo Suyama, Kitakyusyu (JP); Yasuo Hamada, Kitakyusyu (JP)

(73) Assignee: Toto Ltd., Kitakyusyu-Shi, Fukuoka (JP)

( * ) Notice: Subject to any disclaimer, the term of this patent is extended or adjusted under 35 U.S.C. 154(b) by 962 days.

(21) Appl. No.: 10/588,199

(22) PCT Filed: Mar. 24, 2004

(86) PCT No.: PCT/JP2004/004050

§ 371 (c)(1),
(2), (4) Date: Nov. 1, 2006

(87) PCT Pub. No.: WO2005/072673

PCT Pub. Date: Aug. 11, 2005

(65) Prior Publication Data

US 2007/0131798 A1 Jun. 14, 2007

(30) Foreign Application Priority Data

Feb. 2, 2004 (JP) ..... P2004-025946

(51) Int. Cl.

| | |
|---|---|
| ***A61H 9/00*** | (2006.01) |
| ***A61H 33/00*** | (2006.01) |
| ***A47K 3/28*** | (2006.01) |
| ***B05B 3/00*** | (2006.01) |

(52) U.S. Cl. ..... 601/159; 601/160; 4/568; 4/622; 607/82; 607/86; 239/263.1

(58) Field of Classification Search ..... 601/17, 601/55, 152, 154–160, 166; 4/574.1, 541.6, 4/622, 568; 239/263.1; 607/81, 82, 85, 86
See application file for complete search history.

(56) References Cited

U.S. PATENT DOCUMENTS

| | | | | |
|---|---|---|---|---|
| 4,485,503 | A * | 12/1984 | Rolando et al. | 4/622 |
| 4,588,130 | A * | 5/1986 | Trenary et al. | 239/381 |
| 4,920,588 | A * | 5/1990 | Watkins | 4/541.6 |
| 5,241,953 | A | 9/1993 | Sykes | |
| 5,704,079 | A * | 1/1998 | Desnoyers | 4/541.6 |
| 6,602,212 | B1 * | 8/2003 | Ahn | 601/154 |
| 2005/0203447 | A1 * | 9/2005 | Pisani et al. | 601/55 |

FOREIGN PATENT DOCUMENTS

| | | | |
|---|---|---|---|
| EP | 423852 | A1 * | 4/1991 |
| JP | 2 98930 | | 8/1990 |
| JP | 10 510465 | | 10/1998 |
| JP | 11 197204 | | 7/1999 |
| JP | 2003 169832 | | 6/2003 |
| JP | 2004 502511 | | 1/2004 |
| WO | WO 9742926 | A1 * | 11/1997 |

* cited by examiner

*Primary Examiner* — Danton DeMille
(74) *Attorney, Agent, or Firm* — Nixon & Vanderhye PC

(57) ABSTRACT

A foot water-spouting device includes a foot-front water spouting section for spouting water toward the front side of a user's foot and a water-spouting section direction moving mechanism for reciprocating the destination of water spouting of the foot-front water spouting section along a longitudinal direction of the foot. A plurality of spouts may be arranged side-by-side in the foot instep width direction for each of the right and left feet. The pressure of water spouting at a water arrival point may be changed based on or the water spouting amount may be changed based on movement of the water arrival point.

13 Claims, 34 Drawing Sheets

| HAIRLESS SKIN | MERKEL'S DISK RUFFINI ENDING | MEISSNER'S CORPUSCLE | PACINIAN CORPUSCLE |
|---|---|---|---|
| HAIRY SKIN | HAIR DISK RUFFINI ENDING | HAIR FOLLICLE RECEPTOR | PACINIAN CORPUSCLE |
| FUNCTION | DETECT SIZE OF SKIN DISPLACEMENT | DETECT SPEED OF SKIN DISPLACEMENT | DETECT ACCELERATION OF SKIN DISPLACEMENT |
| ADAPTATION SPEED | SLOW | FAST | VERY FAST |

FIG. 1

| REGION | mm |
|---|---|
| FOREHEAD | 23 |
| BLADAL | 4 |
| CHEST | 45 |
| UPPER ARM | 67 |
| FOREARM | 41 |
| WRIST | 31 |
| BACK OF FINGER | 11 |
| PALM SIDE OF FINGER | 4 |
| PALM SIDE OF FINGER TIP | 2 |
| FEMUR | 67 |
| CRUS | 41 |
| DORSUM OF FOOT | 41 |
| DORSUM OF DACTYLUS | 11 |

FIG. 2

FOOT WATER JETTING DEVICE

TECHNICAL FIELD

The present invention relates to a foot water-spouting device for spouting water toward a foot and particularly to a foot water-spouting device which spouts water so that sensory receptors existing on the skin are effectively stimulated.

Recently, devices called foot massage devices and the like provided with a container for accommodating feet and a nozzle for spouting water to the feet accommodated in the container have attracted attention with the growing public interest in health.

One of the reasons is that this type of device has effects, similar to the type in which air bubbles are generated in hot water reserved in a container and feet are soaked therein, that a stain on the foot can be easily removed only by taking off socks and the like and blood circulation is improved since hot water is used. In addition, further beneficial effects can be expected such as recovery of foot fatigue and removal of swelling of the foot, as well as an aesthetic effect to the skin since it has a massaging effect.

In the physiological field, it is said that various types of sensory receptors exist on the skin surface and each of them reacts to provide sense modes of hot/cold/pain/touch (pressure). These receptors constituting cutaneous senses are roughly divided into three sensory modes. That is, touch receptors reacting to touch (vibration/pressure/extension), temperature receptors reacting to hot/cold (change in temperature) and nociceptors reacting to pain.

Among them, the receptors reacting particularly to tactile stimulation include the following types. First, Merkel's disk comprises a Merkel's cell existing in a hairless epithelial germinative layer and nerve ending coupled (synapse) thereto. It is slow in adaptation and shows responses in proportion to the size of skin displacement. Its receptive field is narrow and detects local continuous contact, that is, pressure stimulation. The Merkel's disk mainly reacts to light tactile sense. It is thought that the disk reacts to vibration stimulation with a frequency of 63 Hz or less.

Pincus corpuscle is a smooth disk-state swelling located at the root of a hair on the hair-bearing skin. The dermal papilla below it has some aggregation of Merkel's cells dictated by a single myelinated fiber. It is also called a hair disk or tactile disk.

A Ruffini ending is a nerve ending surrounded by a vesicle existing under lower dermis and subcutaneous cells. Similar to a Merkel's disk, it is a slow adaptation type receptor and indicates a response in proportion to the size of skin displacement. Since it exists in the dermal layer, differently from a Merkel's disk, it is excited even by displacement applied to a far portion, pulling of the skin, for example. A Ruffini ending is normally found both in hairy skin and hairless skin.

A Meissner's corpuscle is a corpuscle existing in the dermal papilla, and an ending of a myelinated nerve which is branched and ended irregularly is surrounded by an egg-shaped vesicle. It is of a fast adaptation type and rapidly adapts to lasting skin pressure that stops its reaction. It is suitable for detection of speed of skin displacement by tactile stimulation. A Meissner's corpuscle is found in hairless skin, palms and soles and is sensitive to lateral stimulation which would distort skin. It is thought to react to vibration stimulation within a frequency range of 16 to 31.5 Hz.

Pacinian corpuscle is a receptor having a large layered structure with the diameter of about 1 mm existing in the lower dermis and subcutaneous tissue. It detects acceleration of skin displacement. That is, it has very fast adaptation and its threshold value becomes the lowest when stimulation of about 200 Hz is repeatedly applied. It has very good sensitivity and is thought to be the first to be excited at contact. Pacinian corpuscle is widely distributed not only in the subcutaneous tissue but periostea, interosseous membrane and internal organs, for example, and captures propagated vibration. Pacinian corpuscle is mainly distributed on the palm and sole and particularly sensitive to pressure stimulation.

Hair (hair follicle receptor) is a sensitive tactile organ. Hair roots have rich distribution of nerves, forming ending winding in the palisade state and capturing change in inclination of hair shaft. Adaptation is fast. (See "Standard Physiology" edited by Toshinori Hongo et al., 5th edition, Igaku-Shoin Ltd., December 2000, pp. 211 to 212, and "Ergonomics Handbook" complied by Kenji Ito et al., Asakura Publishing Co., Ltd., June 2001, pp. 77 to 78)

FIG. 1 summarizes the above. From the above, it is known that the skin is divided into the hairless portion such as palm side of a finger and a hand and a foot and a sole, and the hear-bearing portion occupying the most of the other body surface, and that the type and distribution form of receptors are different between the hairless portion and the hair-bearing portion.

Also, the distribution density of the receptor is different depending on the body portion. When the skin is touched at two points at the same time, if the interval between the two points is far, they are recognized as two points, but if the distance between the two points gets short, it is felt as if only one point is stimulated. This limit distance is called as 2-point differential threshold, and the shorter the distance is, the more sensitive the tactile sense is. The 2-point differential threshold is different depending on the measuring direction, and it is smaller on the arm and leg in the lateral direction than in longitudinal direction, while it is larger in the lateral direction on the trunk.

The 2-point differential threshold at each body portion is shown in FIG. 2. On the limbs, the 2-point differential threshold is substantially the same at femur—upper arm, crus—forearm, and the more it is sensitive to the tactile sense, the closer it is to the terminal of the limb. This tendency is remarkable inside the terminal portions (See "Encyclopedia of Foot" edited by Nobutoshi Yamazaki, Asakura Publishing Co., Ltd., December 1999, pp. 72 to 73).

Then, if stimulation is applied according to the characteristics of these many types and quantity of receptors in the foot, which is a portion particularly sensitive to tactile stimulation, more receptors will be excited more largely and greater comfort should be obtained. That is, if stimulation which is rich in change of touch, pressure, displacement, displacement speed, displacement acceleration, in-plane strain and vibration (corresponding receptor is determined by cycle) is applied, user should be able to obtain more satisfactory comfort. At the same time, this stimulation will propagate to the central nerve through the peripheral nerve, and that should influence the automatic nerve and give relaxation in feeling and body. For that purpose, such measures can be considered as giving stimulation to different types of receptors, stimulation to a portion where receptors are concentrated, giving variety to strength of stimulation, changing the direction of the stimulation, etc., in use, for example.

However, the conventional foot massaging devices focus on promotion of flow of circulatory system such as flow of blood and lymph but not on improvement of comfort felt from receptors on the skin surface through nerves.

For example, there is known a device that a massage effect is to be improved by spouting water to each of the sole (hairless portion) and the surface (hair-bearing portion) of a foot and massaging them (See PCT Japanese Translation Patent Publication No. 10-510465, for example). The sole and the surface of a foot have different distribution of receptors, and complicated tactile sense could be obtained. However, since the destination of water spouting is fixed, the receptors would adapt to that spouting sooner or later, and this comfort can not be kept long.

Other devices are proposed including the one that can optionally change the destination of spouting of water jet (See Japanese Unexamined Patent Application Publication No. 3-111049, for example) or a type to have feet soaked in hot water, and in addition, intensity of jet flow mixed with air bubbles can be controlled (See Japanese Unexamined Patent Application Publication No. 2002-153537, for example). With them, however, the direction and intensity can be controlled according to preference only before use, but they do not change automatically during use and the stimulation applied to the receptors remains monotonous.

In the technical field other than that for the foot massaging device, there is a device with its water spout movable (See Japanese Unexamined Patent Application Publication No. 8-252293, for example), but there is still no proposal paying attention to the receptors. A device paying attention to the destination of water spouting and directing water to "Tsubo (acupressure point)" was proposed (See Japanese Unexamined Patent Application Publication No. 59-146654, for example), but "Tsubo" is different from receptors in the nature and the effect and the means to achieve the object should be inevitably different.

The present invention was made in view of the above circumstances and has an object to provide a leg water-spouting device which effectively stimulates sensory receptors existing in the skin to give greater comfort.

DISCLOSURE OF INVENTION

In order to solve the above-mentioned problems, a leg water-spouting device according to the present invention comprises a foot-front water spouting section for spouting toward a foot-front side of a user, and a water-spouting section direction moving mechanism for moving the direction of water spouting of the foot-front water spouting section along the longitudinal direction of the foot. This leg water-spouting device may further comprise a container body for accommodating the foot of the user.

The foot-front water spouting section may preferably have a plurality of water spouts arranged side by side in the foot width direction in use for each of the right and left foot.

Next, in order to solve the above-mentioned problems, a foot toe is included in a movement path of water arriving points to receive the above spouted water moved by the water-spouting section direction moving mechanism.

According to the present invention, the foot-front water spouting section changes the pressure of spouting water received by the water arriving points according to the position of the water arriving points, and more preferably, the above foot-front water spouting section may have the highest water-spouting pressure received by the water arriving points when the water arriving points are located in the foot toe.

In order to solve the above-mentioned problems, the foot-front water spouting section according to the present invention changes the water-spouting amount according to the position of the water arriving point, and more preferably, the foot-front water spouting section may spout water in the largest flow rate when the water arriving points are located at the foot toe.

Furthermore, in order to solve the above-mentioned problems, the water-spouting section direction moving mechanism according to the present invention moves the above foot-front water spouting section according to movement of the above water arriving points so that the angle of water arriving at the skin surface of the user is changed. More preferably, the water-spouting section direction moving mechanism is provided with a rotary shaft for pivotally supporting either of rotation or rotational movement of the foot-front water spouting section so that the above water arriving points are moved along the longitudinal direction of the foot. And still more preferably, the rotary shaft may be pivotally supported in the container body immediately above the position of the root of the fifth toe or closer to the toe tip side in use.

Furthermore, in order to solve the above problems, movement of the above water arriving points by the water-spouting section direction moving mechanism according to the present invention has a period when water spouted from the above foot-front water spouting section does not hit the toe in the cycle of the movement.

Furthermore, in order to solve the above problems, the foot-front water spouting section according to the present invention is to reciprocate the water arriving point along the longitudinal direction of a foot by the above water-spouting section direction moving mechanism while continuously spouting water.

On the other hand, in order to solve the above-mentioned problems, the leg water-spouting device according to the present invention is further provided with a sole water-spouting section for spouting water toward the sole of a foot. In this case, at least one of a water spouting amount and a water spouting pressure of the sole water-spouting section is preferably changed cyclically.

At least one of foot-front water spouting section and the sole water-spouting section may have its water spouting direction oscillated cyclically.

It is to be noted that the "digit" of a foot is specifically noted as "toe" (such as "hallux valgus (first toe)", for example) to discriminate it from the "digit" of a hand. This notation is adopted in this application. Also, the "foot-front" in this application is opposed to the "sole" and refers to a section including toenails, toes and instep of a foot. And the "fifth toe" in this application refers to so-called "small toe".

BRIEF DESCRIPTION OF THE DRAWINGS

In the accompanying drawings,

FIG. 1 is a table summarizing categories of sensory receptors on the skin;

FIG. 2 is a table summarizing 2-point difference thresholds of body portions;

FIG. 13 show variations of the water-spouting section direction moving mechanism, in which

FIG. 14 show other variations of the water-spouting section direction moving mechanism, in which

FIG. 15 show a water-mill driving mechanism as a variation of the water-spouting section direction moving mechanism not driven by electric power, in which

FIG. 18 show a variation of the water-spouting section direction moving mechanism according to the second preferred embodiment, in which

FIG. 19 show a water-mill driving mechanism as a variation of the water-spouting section direction moving mechanism according to the second preferred embodiment, not driven by electric power, in which

FIG. 22 are views showing the appearance of a third preferred embodiment of the leg water-spouting device according to the present invention, in which

FIG. 23 are appearance views of the leg water-spouting device according to the third preferred embodiment in the state with an opening/closing cover opened, in which

FIG. 24 are views for explaining a water draining method of the leg water-spouting device according to the preferred embodiment, in which

FIG. 28 are views for explaining details of a toe water-spouting nozzle, in which

FIG. 29 are views showing an essential part of the leg water-spouting device according to the preferred embodiment, in which

FIG. 34 are views for explaining a heater of the leg water-spouting device according to this preferred embodiment, in which

DETAILED DESCRIPTION OF PREFERRED EMBODIMENTS

Figure 3:
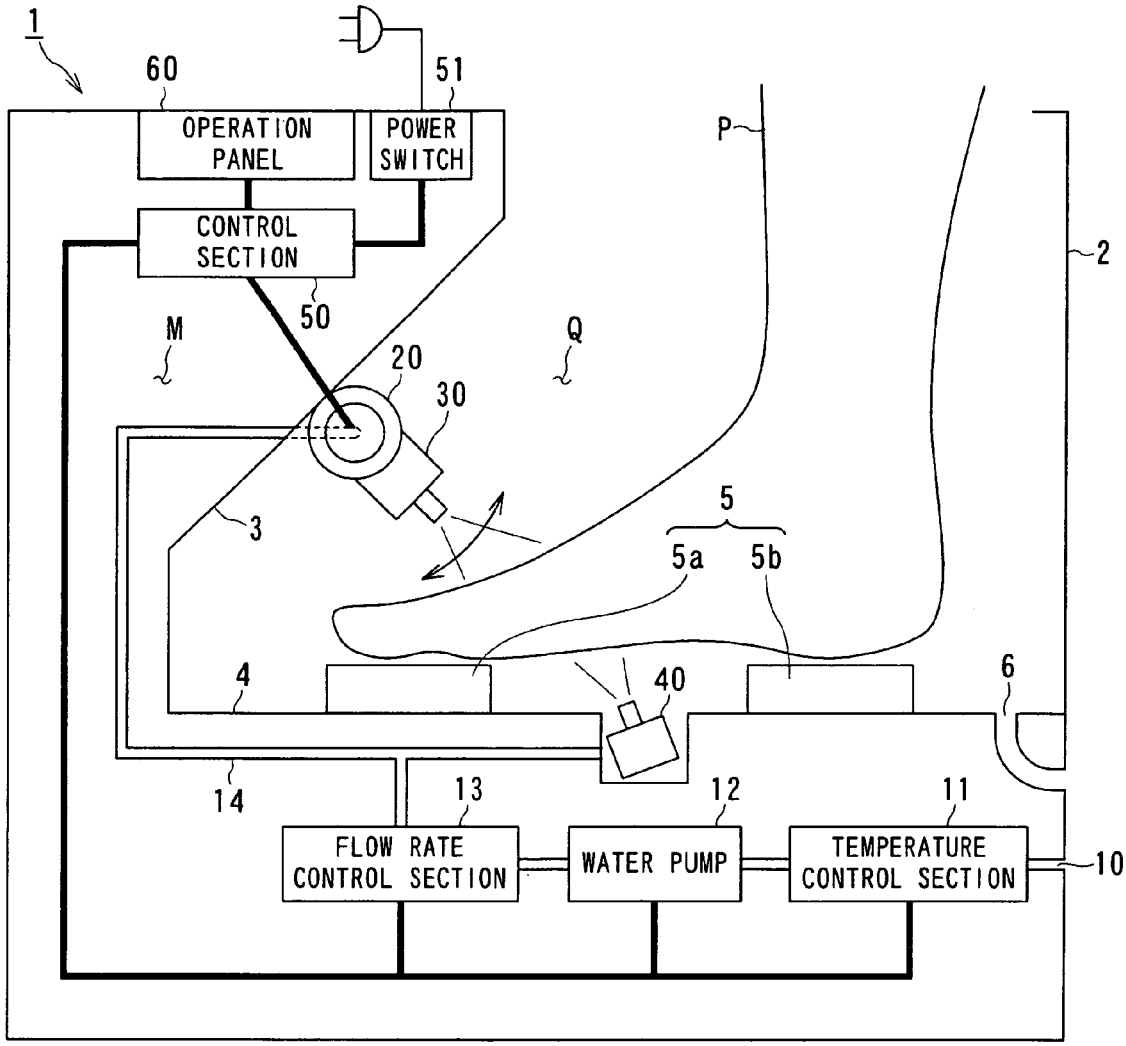
FIG. 3 is a diagram showing an outline of an entire construction of a leg water-spouting device according to a first preferred embodiment.

A first preferred embodiment of a leg water-spouting device according to the present invention will be described referring to attached drawings. FIG. 3 is a view showing an outline of an entire construction of the leg water-spouting device according to this preferred embodiment. A leg water-spouting device 1 shown in this preferred embodiment roughly comprises a container body 2 for accommodating the leg of a user P, a foot rest 5 formed so that the accommodated foot of the user P can be loaded, a water spouting means for spouting water toward the leg accommodated inside the container body 2, a water-spouting section direction moving mechanism 20 for moving the direction of water spouted from this water spouting means, water supply means for supplying water to be used as the spouting water, and a control section 50 for controlling these means.

The container body 2 is formed by a waterproof material such as a synthetic resin and has a boxed state in the approximately rectangular shape as shown in FIG. 3. Inside of this container body 2 is divided by a dividing wall 3 and a dividing floor 4 into a leg accommodation space Q which can accommodate the leg and a device major part M housing the above water supply means, control section, etc.

The foot rest 5 comprises a toe rest 5*a* on which the right and left toes are loaded and a heel rest 5*b* on which the right and left heels are loaded, projected on the dividing floor 4. Therefore, the toe rest 5*a* and the heel rest 5*b* present the shape that 2 parallel rod-state bodies are laterally installed. These toe rest 5*a* and the heel rest 5*b* may have the right and left individual shapes.

At approximately the middle of the toe rest 5*a* and the heel rest 5*b*, in the device major part M in the vicinity where an arch of a foot is positioned when the foot of the user P is loaded, two sole nozzles 40 are provided for spouting water to the right and left soles, respectively, and their tip end portions are exposed into the leg accommodation space Q. Moreover, at the lowest position of the dividing floor 4, a drain outlet 6 is provided for draining water which has been used for spouting to the outside.

On the other hand, immediately above the vicinity of the position of the toe when the foot of the user P is loaded, a foot-front nozzle 30 through which water supplied from the water supply means communicates is extended approximately horizontally between the both side faces of the container body 2, and nozzle units 34 (See FIG. 4) are provided at proper positions for spouting water toward the foot-front of the user P in the path of this foot-front nozzle 30. This foot-front nozzle 30 is rotatably controlled by the water-spouting section direction moving mechanism 20. This foot-front nozzle 30 and the above sole nozzle 40 constitute the water spouting means.

The water supply means comprises a connection section 10 connected to an external water feed facility (not shown), a temperature control section 11 for controlling the temperature of water used for spouting, a water pump 12 for pumping water for spouting to the water spouting means, a flow rate control section 13 for controlling the flow rate of the water spouting means, and a water pipe 14 for connecting them so that water can communicate through them.

The temperature control section 11 supplies water at a temperature appropriate for massaging of a leg by mixing water and hot water supplied from an external feed water pipe and an external hot-water feed pipe (not shown) connected by the connection section 10 at an appropriate mixing ratio. Alternatively, it may be so constituted that water at an appropriate temperature is supplied by heating feed water from the external feed water pipe connected by the connection section 10. Alternatively, water supply controlled outside at an appropriate temperature may be received.

The water pump 12 pumps up such water controlled to an appropriate temperature and pumps it to the water spouting means through the flow rate control section 13.

The flow rate control section 13 comprises electromagnetic valves and the like and variably controls the flow rate from the water spouting means according to instruction from the control section 50. The supplied water is branched to the foot-front nozzle 30 and the sole nozzle 40 after passing through this flow rate control section 13.

In the device major part M on the back of the foot-front nozzle 30, the control section 50 is attached in the water tight manner for driving the electromagnetic valve of the flow rate control section 13 and for sending a signal for controlling the water-spouting section direction moving mechanism 20 based on the instruction of the user P through an operation panel 60 provided on the top face of the container body 2. This control section 50 may be placed on the back face of the dividing wall 3 or the lower part of the dividing floor 4. Moreover, the operation panel 60 may be constituted as a remote controller separated from the container body 2.

The foot-front nozzle 30 and the sole nozzle 40 in this preferred embodiment constitute the foot-front water spouting section and the sole water-spouting section of the present invention, respectively.

The entire construction of the leg water-spouting device 1 has been described, and next, the water spouting means and the water-spouting section direction moving mechanism 20 will be described in detail. The water spouting means is provided above the toe rest 5*a*, as mentioned above and includes the foot-front nozzle 30 for spouting water directed from the toe to the ankle of the user P, while being rotated, and the sole nozzle 40 provided in the middle of the foot rests 5 and spouting water directed to the right and left soles of the user P, while being oscillated, respectively.

Figure 4:
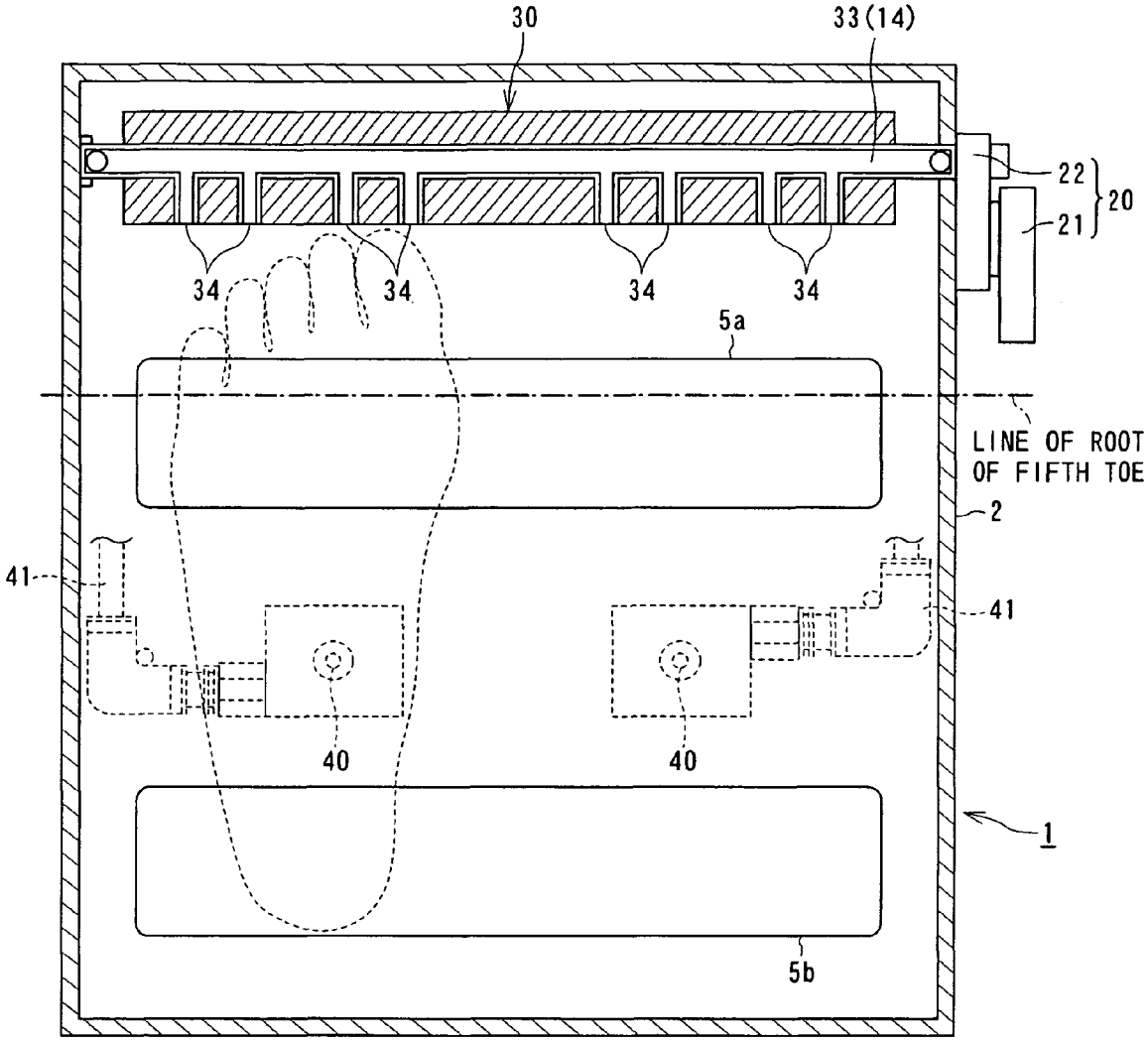
FIG. 4 is a plan view showing a foot-front nozzle and a sole nozzle.

In the foot-front nozzle 30, 3 to 4 nozzle units 34 for each of the right and left foot are provided in the skewered state at predetermined positions of a shaft 33 formed with a hollow cylindrical inside and also acting as the water pipe 14 as shown in FIG. 4. Moreover, at one end of the foot-front nozzle 30, the water-spouting section direction moving mechanism 20 for rotating this foot-front nozzle is connected. The nozzle units 34 are mounted in parallel with each other at the positions of the same phase on the shaft 33.

By arranging the plural nozzles side by side in this way, water can be spouted in a wider range at the same time so that more receptors can react. Particularly, at the terminal portions as foot, the receptors exist more closely in the lateral direction than in the longitudinal direction, and by arranging the water arriving points in the lateral direction, receptors can sense differences in stimulation generated in the water spouting zone more efficiently. Moreover, by arranging the nozzle units 34 on the shaft 33 with shifted phases so that the distance to the foot-front nozzle 30 and the angle of the spouted water to the skin are differed at the water arriving points of the respective nozzle units 34 so as to give more complicated stimulation with different water hitting direction and intensity.

The foot is a portion where many receptors concentrate as in the hand, and when water is spouted to this portion, reaction of the receptors is large and comfort can be easily obtained. Particularly, the front of the foot-front is not as thick as that of the sole, and spouting water to the foot-front can give direct stimulation to the receptors with the lower energy.

The water-spouting section direction moving mechanism 20 for driving the water-surface nozzle 30 is provided with a motor 21 for rotationally moving the foot-front nozzle 30, and this motor 21 for move is incorporated in a gear chassis 22 and connected to the shaft 33 through a reduction gear group for reducing the rotating speed of this motor and a cam 23 (not shown). The shaft 33 is a rotary shaft of the motor 21 for move and also serves as the water pipe 14 for feeding water to the foot-front nozzle 30.

Figure 5:
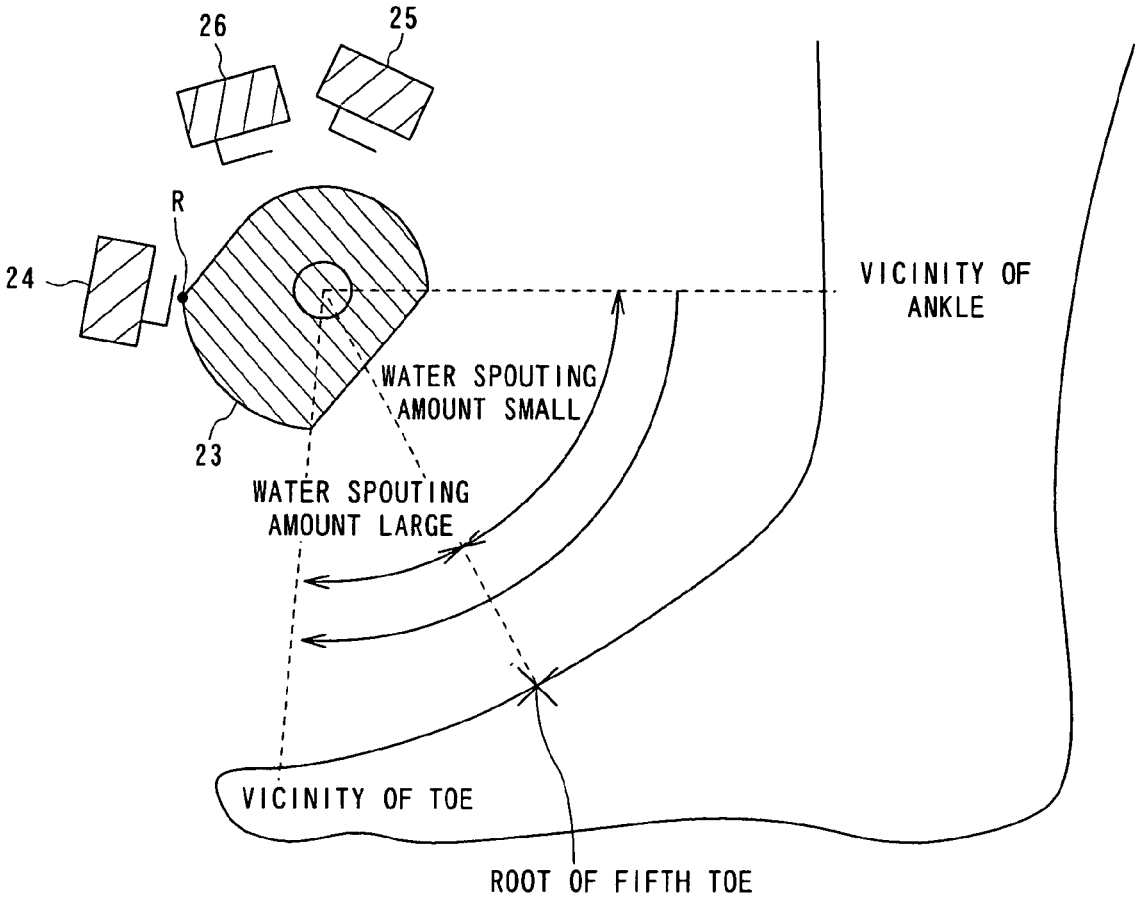
FIG. 5 is an explanatory view showing a relation between a cam and a limit switch of a foot-front nozzle driving section.

In the vicinity of this cam 23 , as shown in FIG. 5, there are provided two switches 24, 25 for detecting a rotating position of the foot-front nozzle 30 and a switch 26 between them for transmitting a signal for changing the water spouting amount. This motor 21 for movement is any motor rotatable both in forward and backward directions such as a stepping motor, servo motor, reversible motor or the like. Also, the switches 24 to 26 may be proximity sensors, photoelectric sensors, limit sensors or the like.

The cam 23 rotates with rotation of the shaft 33 and alternately turns ON and OFF the respective switches 24, 25. The reduction gear group transmits a rotary driving force applied by the motor 21 for move through a gear in the input stage to a gear in an output stage after reducing it to a predetermined rotating speed. The motor 21 for move rotates at a predetermined rotating speed in the forward/backward direction under control of the control section 50 and transmits its rotary driving force to the gear in the above input stage.

The switches 24, 25 output an electric signal indicating a current angle of the rotating shaft to a microcomputer 52 of the control section 50 when brought into the ON state. FIG. 5 shows a position of the cam 23 in the state where the foot-front nozzle 30 is at the highest angle (state directing to the vicinity of the ankle of the user P), and in this state, a switch 64 is ON and a switch 65 is OFF. As a cam 63 is rotated in the arrow direction from this position, the cam 23 is brought to a position where the foot-front nozzle 30 is at the lowest angle (state directing to the vicinity of the toe of the user), and the switch 24 is turned OFF and the switch 25 is turned ON.

When the switch 24 is turned ON in this way, the rotation of the motor 21 for move is reversed from the ankle direction to the toe direction. When the switch 25 is turned ON in this state, the rotation of the motor 21 for move is reversed from the toe direction to the ankle direction. Therefore, the foot-front nozzle 30 continues water spouting while rotationally moving from the ankle to the instep, through the root of the toe and toe to the tiptoe of the user P. By this, since the various receptors existing on the foot front intermittently receive stimulation, lowering of sensitivity by adaptation hardly occurs. Moreover, since water is spouted from the diagonal direction with respect to the skin surface, stimulation particularly with different displacement or in-plane strain can be applied.

In this case, water spouting of the foot-front nozzle 30 may be so controlled that water is spouted only in the rotation in one direction from the tiptoe to the ankle or the ankle to tiptoe in conjunction with ON/OFF of the switches. Alternatively, it may be so constituted that, irrespective of ON/OFF of the switches, the foot-front nozzle 30 is continuously rotated only in one direction, in the direction rotating from the switch 25 to the limit switch 24, for example, and when the switch 25 is turned ON, the foot-front nozzle 30 is made to spout water, while when the switch 24 is turned ON, the water spouting is shut off so that water is spouted only when the foot-front nozzle 30 is directed from the tiptoe to the ankle.

On the other hand, when the switch 26 detects passage of a point R on the cam 23 in the vicinity, it sends an ON signal to the control section 50. At this time, the water arriving point of the foot-front nozzle 30 is in the vicinity of the root of the fifth toe on the foot-front.

The control section 50, upon receipt of this ON signal, gives an instruction to increase the flow rate to the flow rate control section 13 when the foot-front nozzle 30 is rotated from the ankle side to the tiptoe side, while rotation of the foot-front nozzle 30 from the tiptoe side to the ankle side is detected, it gives an instruction to decrease the flow rate to the flow rate control section 13. In this way, the control section 50 sends instructions of increase/decrease of a flow rate per receiving of the ON signal from the switch 26 alternately to the flow rate control section 13. By this, at the tiptoe where the receptors concentrate, stimulation to the receptors is enhanced by flow rate increase and more receptors can react.

Since the sole belongs to the hairless portion as compared to the hair-bearing foot-front, the receptors of the different types from those on the foot-front exist thereon. Therefore, by spouting water to the sole, different reaction can be obtained from the case of water spouting on the foot-front. Particularly, if the foot-front and the sole are stimulated at the same time, more complicated stimulation can be gained.

Figure 6A:
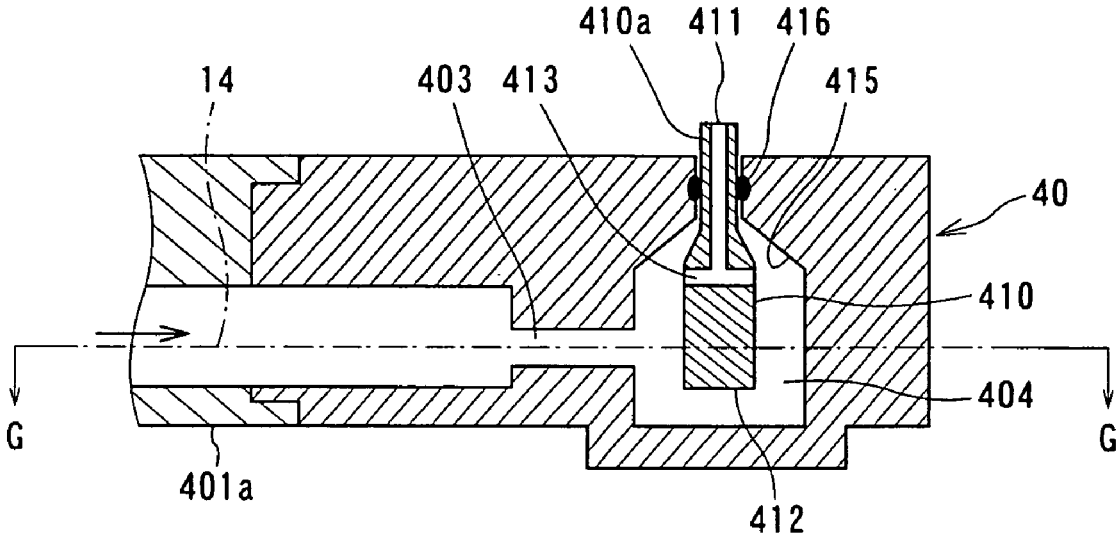
FIG. 6A is a lateral sectional view of the sole nozzle suitable for a swirling flow and FIG. 6B is a G-G view on arrow in FIG. 6A.
Figure 6B:
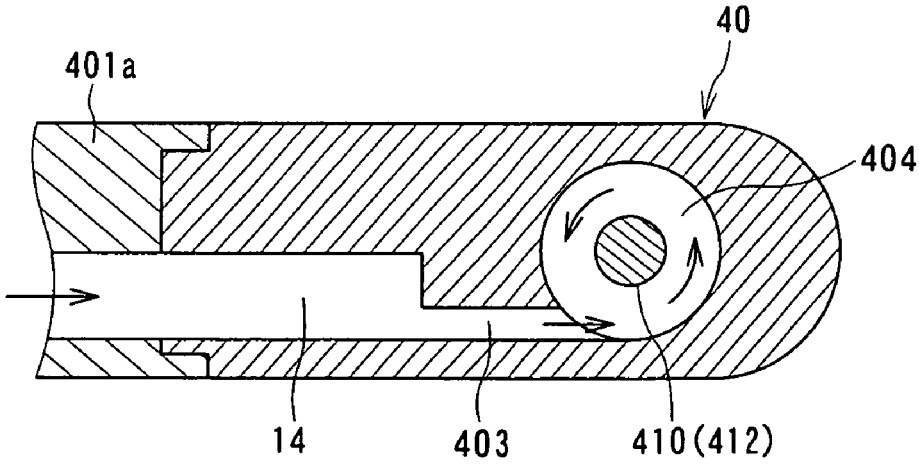

While the water-surface nozzle 30 is rotated by electric control, the sole nozzle 40 to the sole is rotated by water pressure from the water pipe 14. FIG. 6A is a lateral sectional view of the sole nozzle 40 suitable for a swirling flow from the water pipe 14 and FIG. 6B is a G-G view on arrow in FIG. 6A.

As shown in the figures, this sole nozzle 40 is provided with a swirl chamber 404 formed in the cylindrical shape as an inflow chamber into which water flows, and water is supplied to this swirl chamber 404 via the water pipe 14 and a swirl chamber inlet passage 403. The swirl chamber inlet passage 403 is a nozzle pipeline and is formed with a cross-sectional area of flow smaller than that of the water pipe 14 and connected to the swirl chamber eccentrically with respect to the center axis of the swirl chamber 404. Therefore, the water from the swirl chamber inlet passage 403 flows into the swirl chamber 404 from its tangent direction and generates a swirling flow, as shown in an arrow in the figure. In this case, since the cross-sectional area of flow in the swirl chamber inlet passage 403 is smaller than that of the water pipe 14, flow velocity of water flowing into the swirl chamber 404 can be increased.

A water spouting body 410 is incorporated in this swirl chamber 404. This water spouting body 410 has a water spouting section 410*a* in the shape of a column with a small diameter provided with a water spout 411 for spouting water and a force receiving section 412 in the shape of a column with a large diameter continuing to this water spouting section. This force receiving section 412 is located in the swirl chamber 404 and receives various forces, which will be described later, from the above swirling flow and is also involved in revolution driving with oscillation of the water spouting body 410, which will also be described later. The force receiving section 412 is provided with a feed water pipeline 413 penetrating in the lateral direction, and water in the swirl chamber 404 is guided from this feed water pipeline 413 to the water spout 411. The feed water pipeline 413 is opened crossing the force receiving section 412, and the total of the passage sectional area of this feed water pipeline 413 is larger than that of the water spout 411. Therefore, when water is guided from the feed water pipeline 413 to the water spout 411, water is rectified according to the size of the area, and water spouted from the water spout 411 is stabilized.

The water spouting body 410 is inserted and supported with the water spouting section 410*a* inscribed in a seal section 416 provided at the upper part of the opening of the swirl chamber 404, and the force receiving section 412 is suspended approximately at the center in the swirl chamber 404. Therefore, when water flows into the swirl chamber 404 from the swirl chamber inlet passage 403, the water causes a swirling flow around the force receiving section 412 along the inner circumferential wall surface of the swirl chamber 404.

With respect to the inner diameter of the cylindrical swirl chamber 404, the outer diameter of the force receiving section 412 may be set to about 40%, for example. Also, the outer diameter of the force receiving section 412 may be set to about 35 to 80% of the inner diameter of the swirl chamber 404, preferably to about 40 to 70%.

The seal section 416 supporting the water spouting body 410 as mentioned above comprises an elastic body such as an O-ring and a seal ring and supports the water spouting body 410 while the water spout 411 is faced outside of the swirl chamber 404 as shown in the figure. Moreover, since this seal section 416 is an elastic body, the force receiving section 412 is made capable of tilting in each direction in the swirl chamber 404 while the water spouting body 410 is supported and yet, oscillation is made possible with this force receiving section 412 being tilted. Also, since the seal section 416 is an elastic body, the water spouting body 410 is capable of rotation of the water spouting body 410 itself around the center axis in the swirl chamber 404 and revolution in the conical state with the support spot by the seal section 416 as its apex. Such rotation and revolution is caused by the force receiving section 412 and the above swirling flow.

The upper wall of the swirl chamber 404 is a taper guide section 415 with a small diameter of the water spouting section 410 on the water spouting section 410*a* side. This taper guide section 415 restricts the maximum tilting angle of the force receiving section 412 and thus, the water spouting body 410.

Moreover, as shown in FIG. 3, in the device major part M on the back of the foot-front nozzle 30, the control section 50 is provided in the shut-off state from water. In this control section 50, electronic parts of control circuits responsible for the core of control of the leg water-spouting device 1 are mounted.

Figure 7:
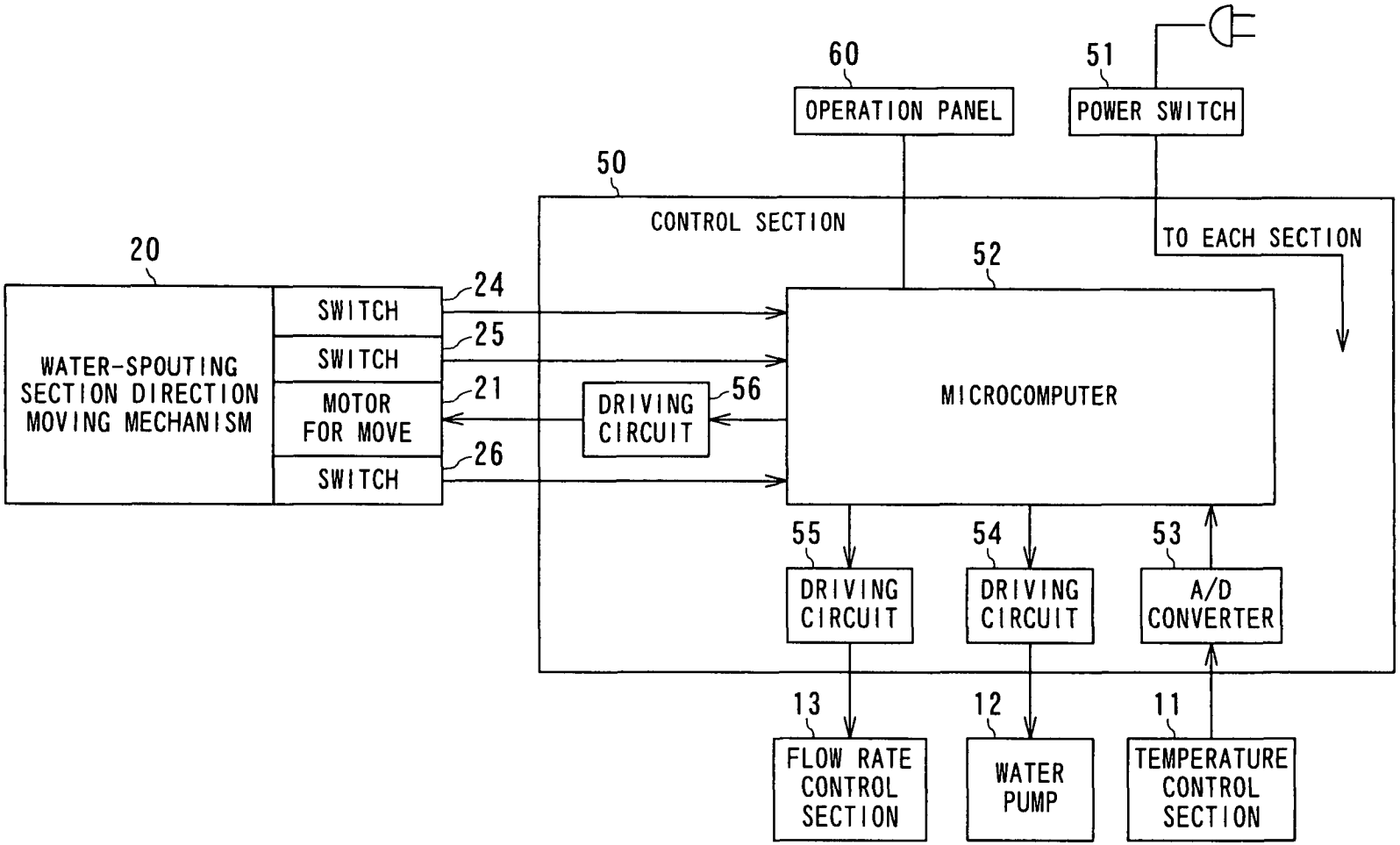
FIG. 7 is a block diagram showing electrical systems.

The control section 50 is provided with a microcomputer 52 as shown in FIG. 7, and by giving a program describing a procedure to execute processing of driving/control of the log water-spouting device 1 to this microcomputer 52, a part of means for realizing such driving/control is functionally executed. In a memory (not shown) of this microcomputer 52, such a program is stored in advance.

Also, in the control section 50, various circuits are mounted on the same control board as peripheral circuits and interfaces of the microcomputer 52. These circuits include an a/D converter 53 and driving circuits 54 to 56. These various circuits are electrically linked with various detecting means and driving means in the leg water-spouting device 1 and receives/converts detected signals to the microcomputer 52 as well as receives/converts the control signal outputted by processing of the microcomputer 52 and outputs it to the driving means.

When this is described more specifically, a hot-water supply thermister (not shown) as detecting means for detecting supplied hot-water temperature is provided at a temperature control section 11, and a detection signal of this hot-water supply thermister is sent to the A/D converter 53.

Moreover, the switches 24 to 26 are provided at the water-spouting section direction moving mechanism 20, and ON/OFF signals of these switches 24 to 26 are directly sent to the microcomputer 52.

On the other hand, the driving circuits 54 to 56 receiving a control command from the microcomputer 52 output respective driving signals to the water pump 12, the electromagnetic valve of the flow rate control section 13 and the motor 21 for move of the water-spouting section direction moving mechanism 20.

The control panel 60 is connected to the control section 50, and by this, operation information by the user P with respect to the operation panel 60 is sent to the microcomputer 52.

When the user P presses the "start/stop" button on the operation panel 60, the microcomputer 52 operates the water pump 12 by this instruction. By this, water in the temperature control section 11 is sent to the water pipe 14, branched to the sole nozzle 40 and the foot-front nozzle 30 when it reaches the branching place of the water pipe 14, and spouted from the respective water spouting nozzles.

Figure 8:
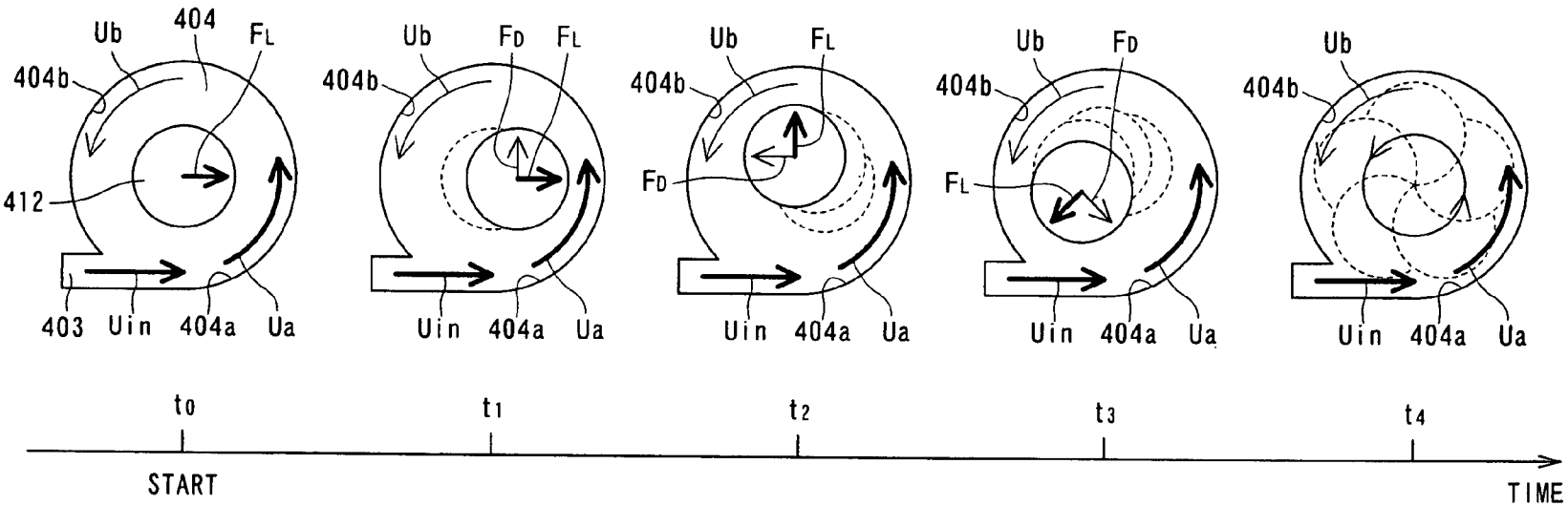
FIG. 8 is a view for explaining behavior of the sole nozzle.

The state of water spouting at the sole nozzle 40 as water spouting was started as above and its behavior will be described. FIG. 8 is a view for explaining the behavior of the force receiving section 412 after water flows into the swirl chamber 404 and the mode of a force applied to the force receiving section 412 as time elapses. In this figure, the flow velocity at the communication section of the swirl chamber inlet passage 403 is represented as Uin, the flow velocity at a circumferential wall section 404*a* on the extension of the opening of the swirling flow inlet passage 403 as Ua, the flow velocity at a circumferential wall section 404*b* opposed to the section concerned as Ub, the lift force acting on the force receiving section 412 as FL, and a drag as FD.

As can be known from this action relation, the force receiving section 412 revolves according to the swirling flow of water in the swirl chamber 404 while oscillating in the tilted attitude.

Figure 9:
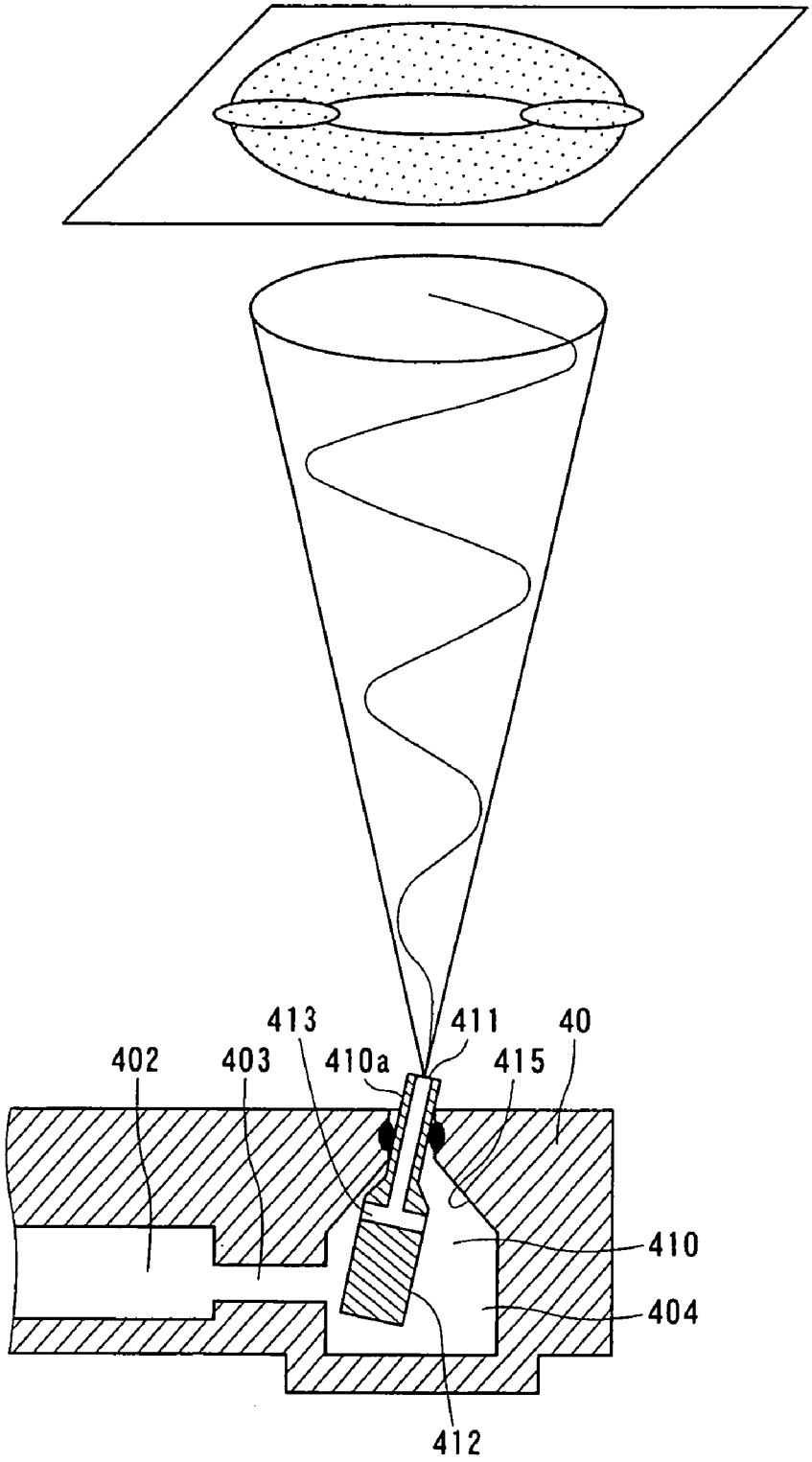
FIG. 9 is a view for explaining a mode of water spouting of the sole nozzle.

FIG. 9 is a view for explaining the mode of water spouting obtained when the force receiving section 412 behaves in this way. As shown in this figure, when the water spouting body 410 starts oscillating revolution, the water spout 411 revolves with the oscillating revolution of the water spouting body 410 while changing its water spouting direction. Therefore, the water spout 411 spouts water while following a spirally enlarged orbit and as a result, it realizes revolving water-spouting in the conical state. Thus, the water-spouting orbit can be made as a conical revolving water-spouting in the conical state on an orbit much larger than that of the water spout 411 so that water can be spouted in a wider range.

Therefore, according to this sole nozzle 40, the revolving water-spouting in the conical state can be realized without driving the nozzle itself by a motor and the like, whereby water arriving in a wider range can be obtained. Since the water arriving points are changed in a wider range, the respective receptors receive intermittent water sporting, adaptation to stimulation can be prevented, and high massaging effect can be gained. Particularly, the back of the toes, "Yusen" (dent portion closer to the tip toe from the center of the sole) and the arch have relatively thin corneum in the sole, and by including them in the water-spouting range, the receptors can be effectively made to react.

Also, if the construction of this sole nozzle 40 is employed for the respective nozzle units 34 of the foot-front nozzle 30, in addition to the large movement of the water arriving points in the longitudinal direction from the tiptoe to the ankle by the water-spouting section direction moving mechanism 20, movement in the foot width direction and finer oscillation can be obtained, which realizes more complicated and subtle stimulation.

The rotation of this sole nozzle 40 is continuously made automatically in the water-spouting period in this preferred embodiment since it is mechanically driven by a water flow, but by electromagnetically operating it, selection of rotation and stop can be made in the construction.

Figure 10:
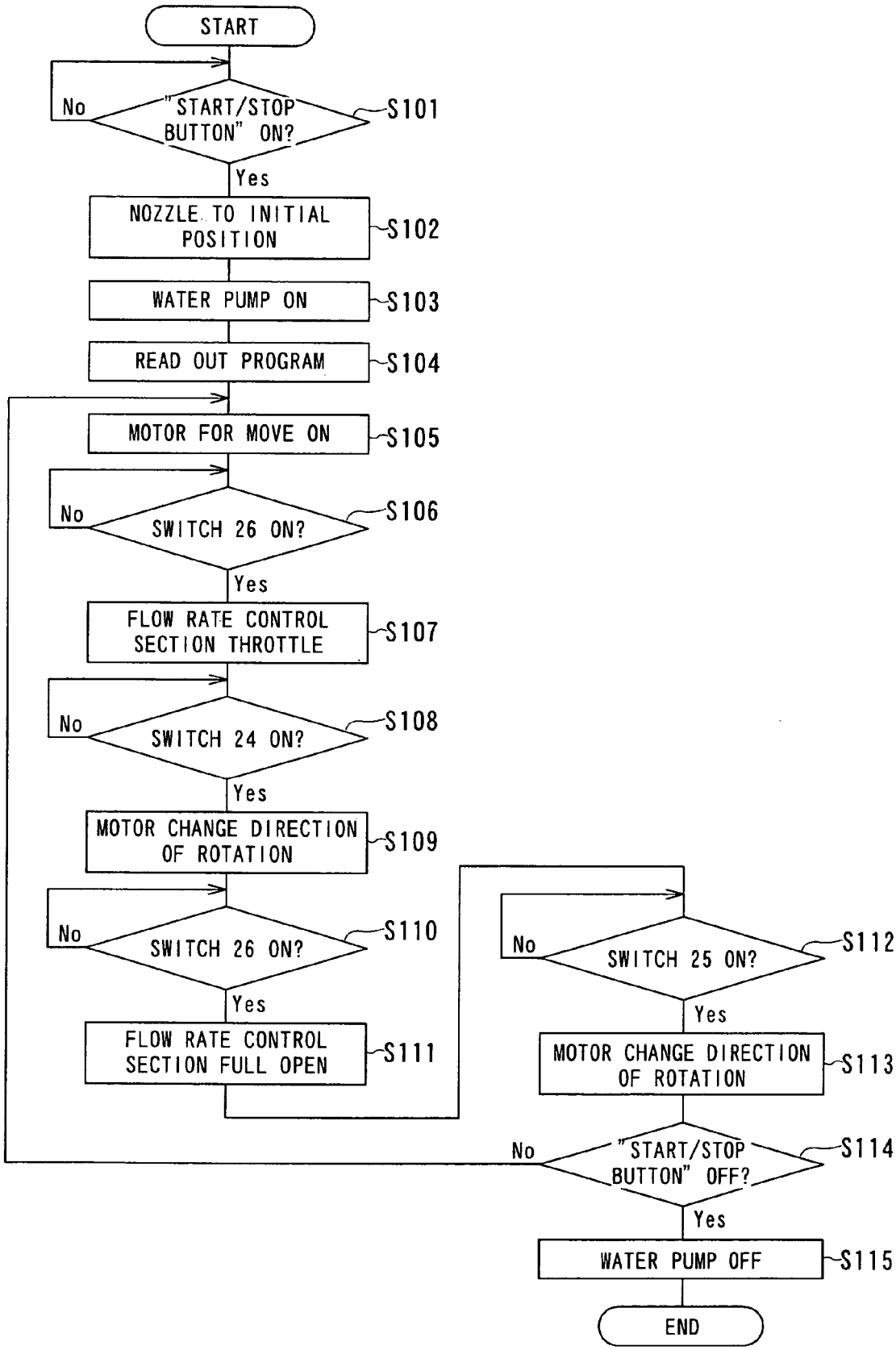
FIG. 10 is an outline flowchart showing water-spouting processing of a foot-front nozzle executed by microcomputer of the leg water-spouting device.

Next, operation of the foot-front nozzle 30 will be described referring to a flowchart shown in FIG. 10. When the "start/stop" button on the operation panel 60 is first pressed by the user P (Step S101), the microcomputer 52 moves the foot-front nozzle 30 to the initial position, a direction oriented to the lowermost end, for example, or in other words, the position where the foot-front nozzle 30 is directed to the tiptoe of the user P (Step S102) and operates the water pump 12 (Step S103).

At the same time, the microcomputer 52 reads out a program of a move mode for controlling the operation of the foot-front nozzle 30 (Step S104). This move mode program gives an instruction to the motor 21 for move to drive the foot-front nozzle 30 at a constant speed (Step S105).

By this move, the foot-front nozzle 30 moves its water-spouting destination with rotational movement of the shaft 33 while spouting water according to the instruction of the program. If the initial position is set to the tiptoe side, the electromagnetic valve of the flow rate control section 13 is in the full open state, and water is spouted at the maximum flow rate.

When the direction of the water spouting is moved from the tiptoe to the ankle and the shaft 33 reaches a position to turn ON the switch 26 (Step S106), the microcomputer 52, upon receipt of the signal from the switch 24, sends an instruction to the flow rate control section 13 to throttle the electromagnetic valve (Step S107). By this, in the vicinity of the ankle, stimulation with intensity different from that for the tiptoe is given, and the user P can obtain different comfort.

When the foot-front nozzle 30 continues rotation and the shaft 33 reaches a position to turn ON the switch 24 (Step S108), the microcomputer 52 sends a signal to the motor 21 for move to change the direction of rotation of the shaft 33 (Step S109) and continues water-spouting.

When the shaft 33 reaches the position to turn ON the switch 26 again (Step S110), the microcomputer 52, upon receipt of the signal from the switch 26, sends an instruction to the flow rate control section 13 to fully open the electromagnetic valve (Step S111). By this, at the tiptoe side where the receptors more concentrate than on the ankle side, water spouting with higher density can be realized.

When the shaft 33 reaches the position to turn ON the switch 25 (Step S112), the direction of rotation is reversed again (Step S113).

The foot-front nozzle 30 repeats this operation till the "start/stop" button on the operation panel 60 is pressed again and an instruction of end is given (Step S114: No). By this operation, the receptors from the tiptoe to the ankle can be covered and the receptors in a wider range can be stimulated. Moreover, since the respective receptors receive intermittent stimulation, dulling of reaction due to adaptation can be prevented.

If the program stored in the memory is different, the operation will also be different. For example, it is possible to stop water spouting during rotational movement from the ankle side to the tiptoe side or a program may be loaded that movement is stopped at a certain position and after water is spouted in the concentrated manner at the portion for a certain period of time, instruction shall be given to resume the rotational movement. Alternatively, it is possible to reciprocate between the tiptoe to the root of the fifth toe and to stop water spouting at both ends. Moreover, the rotating speed of the foot-front nozzle 30 may be changed or that may be selected from a plurality of programs.

Moreover, in this preferred embodiment, the flow rate is changed for the case where the foot-front nozzle 30 spouts water to the tiptoe side and the case where it spouts water to the ankle side, but it is possible to constitute that the flow rate is fluctuated cyclically or at random irrespective of the water-spouting destination. Alternatively, the water-spouting amount may be changed according to the position of the water arriving points by alternately providing an area with a large water-spouting amount and another area with a smaller water-spouting amount. By this change of water spouting form, complicated skin feeling can be also realized and adaptation can be prevented. Moreover, since the sole nozzle 40 and the foot-front nozzle 30 both use the common flow rate control section 13, the flow rate on the foot-front side is changed at the same time as the flow rate on the sole side, and diversified stimulation can be applied also to the sole.

When the user P presses the "start/stop button" (Step S114: Yes), the microcomputer 112 stops the water pump 12 and finishes water spouting (Step S115). The above process can be controlled not by the microcomputer 52 but a sequencer.

Figure 11:
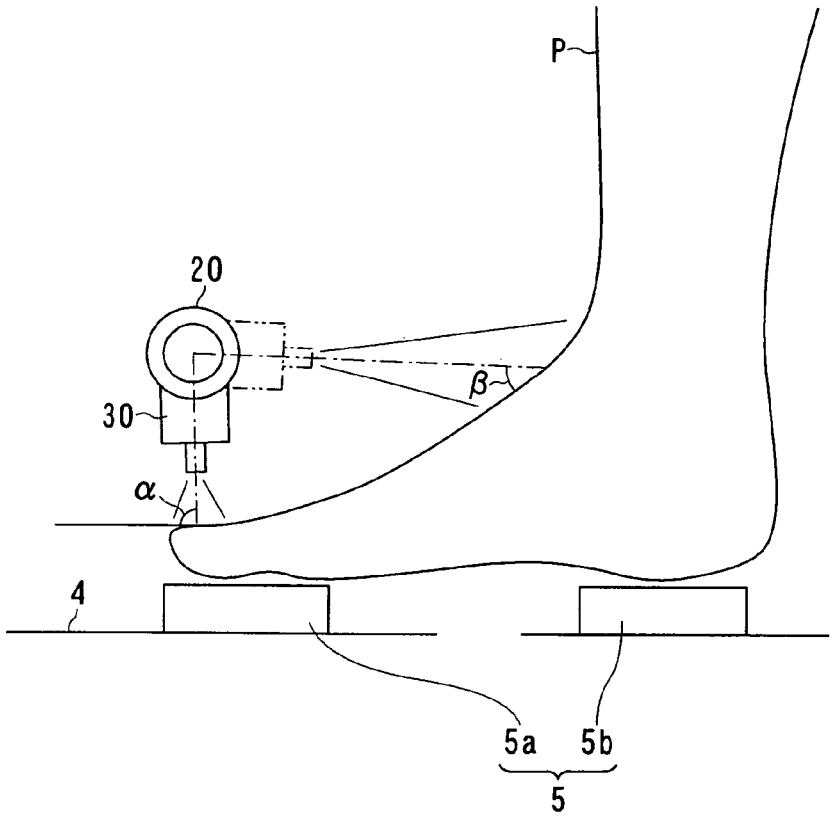
FIG. 11 is a view for explaining positional relation between a water-spouting section direction moving mechanism and a foot of a user.

As shown in FIG. 11, the foot-front nozzle 30 is placed at a position relatively close to and immediately above the tiptoe of the user P through the water-spouting section direction moving mechanism 20. By this, when water is spouted to the tiptoe side, the water is spouted from the nearby position and at an angle of a close to a right angle with respect to the skin surface, and pressure, that is, stimulation applied to the receptors at the tiptoe is relatively large. On the other hand, when water is spouted to the ankle side, the water is spouted from a far position and at a small angle of β with respect to the skin surface, and the pressure applied to the receptors of the ankle is relatively small. By this, larger stimulation is applied to a portion where the receptors concentrate to give greater comfort, while the stimulation is weakened on the other portion to prevent adaptation.

Figure 12:
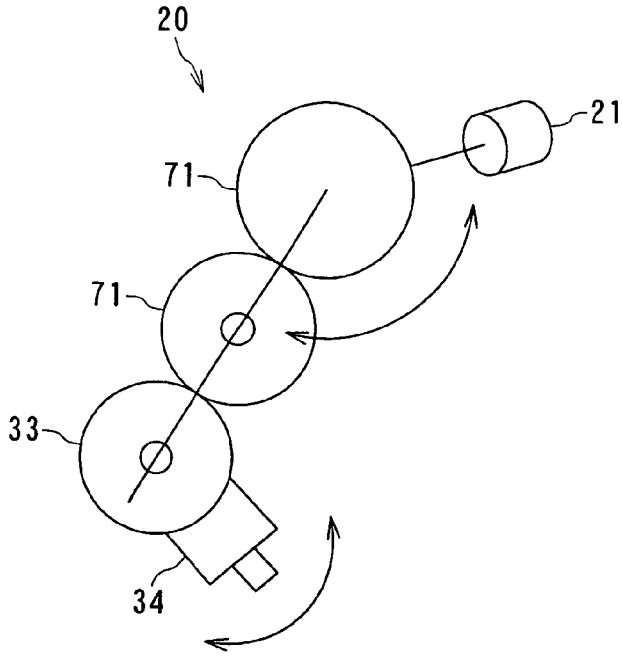
FIG. 12 is a schematic view showing a gear driving mechanism, which is a water-spouting section direction moving mechanism according to a first preferred embodiment.

In this preferred embodiment, the motor 21 for movement to rotationally move the foot-front nozzle 30 is provided as the water-spouting section direction moving mechanism 20, and a gear driving mechanism in which this motor 21 for movement is connected to the shaft 33 through a reduction gear 71 group for reducing the rotating speed of this motor 21 and the cam 23 has been described above. This is shown schematically in FIG. 12. According to this mechanism, by combining a motor which can be rotated both in forward/backward directions such as a stepping motor, a servo motor, a reversible motor, etc. with switches, the foot-front nozzle 30 can be rotationally moved in an arbitrary section.

The water-spouting section direction moving mechanism 20 is not limited to this gear driving mechanism, but it is possible to construct it with various mechanisms. Some variations will be described below.

Figure 13A:
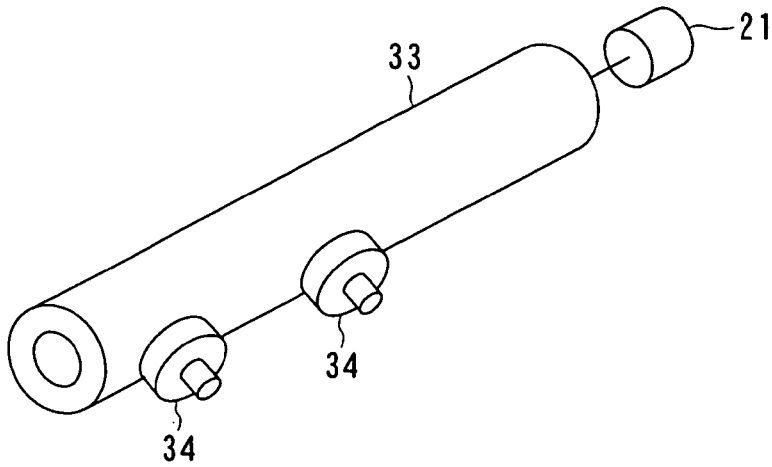
FIG. 13A shows a direct driving mechanism.

FIG. 13A shows a direct driving mechanism in which the motor 21 for move is directly connected to one end of the shaft 33 of the sole nozzle 30. In this mechanism, there is nothing to be intervened between the motor 21 and the mechanism can be made in a simple construction. The cam 23 for switch is inserted between the motor 21 and the shaft 33.

Figure 13B:
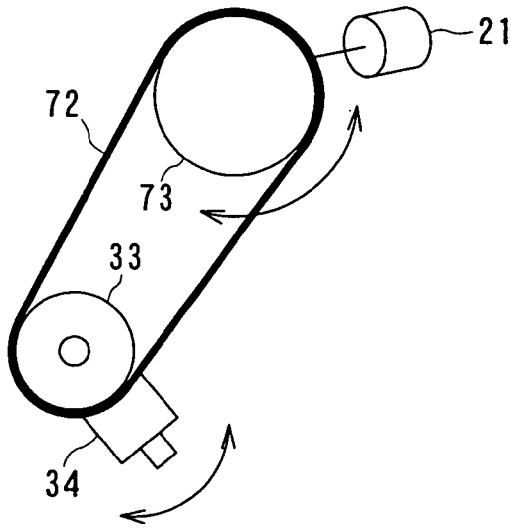
FIG. 13B shows a belt driving mechanism.
Figure 13C:
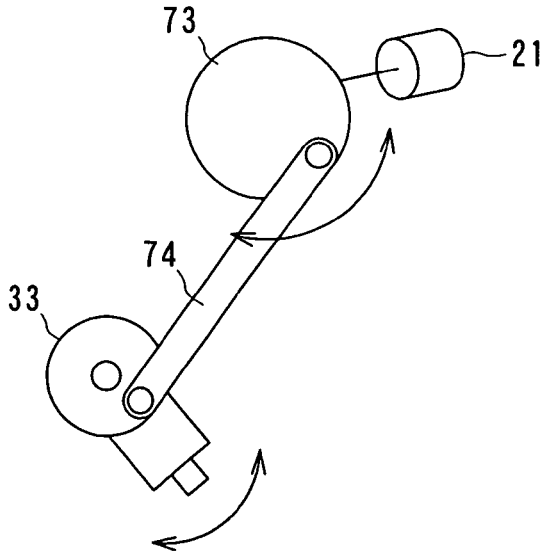
FIG. 13C shows a link mechanism.

FIG. 13B shows a belt driving mechanism using a belt 72 instead of the gear 71 in this preferred embodiment. In this case, the cam 23 may be provided with a drum 73 either on the motor 21 side or on the shaft 33 side. Similarly, FIG. 13C shows a link driving mechanism using a link 74 instead of the gear 71 in this preferred embodiment. The motor 21 for movement used in each of the mechanisms in FIGS. 13A to 13C is a motor which can be rotated in both the forward/backward directions such as a stepping motor, a servo motor, a reversible motor, etc.

Figure 14A:
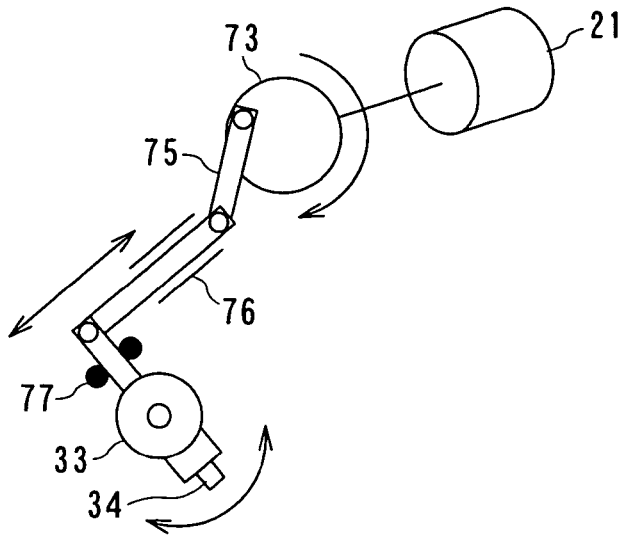
FIG. 14A shows a slider crank mechanism.

FIG. 14 shows an example of a case where a DC brushless motor or the like which can not be rotated backward is used as the motor 21 for move. FIG. 13A shows a slider crank mechanism, in which a crank 75 advances/retreats along a guide 76 with rotational movement of the motor 21, and the foot-front nozzle 30 oscillates with support guides 77 as the support point.

Figure 14B:
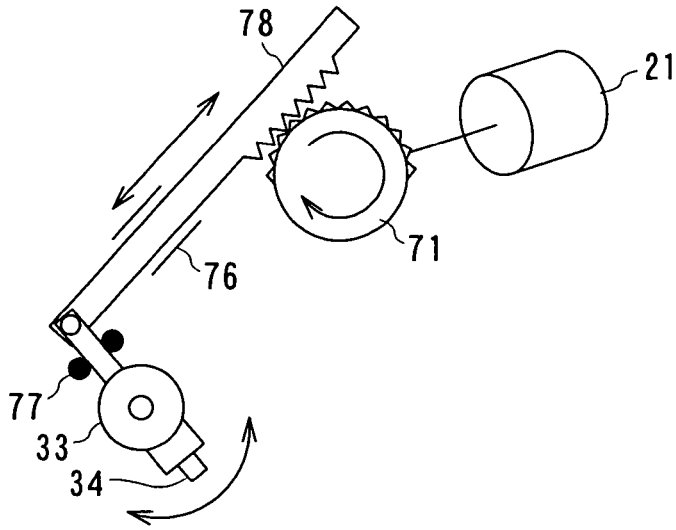
FIG. 14B shows a gear slide mechanism.

FIG. 14B shows a gear slide mechanism. While teeth provided at a part of the gear 71 is meshed with teeth provided at a part of a slide bar, the slide bar 78 slides upward with rotation of the gear 71, and the foot-front nozzle 30 oscillates downward with the support guides 77 as the support point. On the other hand, when the slide bar 78 has fully risen and the teeth on the gear is not meshed with the teeth on the slide bar any more, the slide bar 78 slides down by its own weight along the guide 76, and the foot-front nozzle 30 oscillates upward with the support guides 77 as the support point.

Figure 14C:
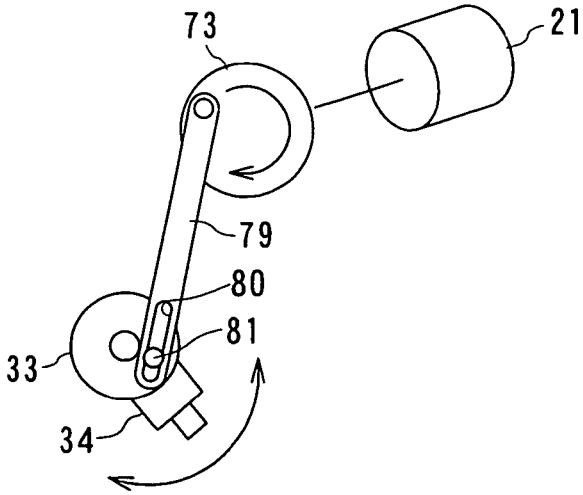
FIG. 14C shows a link mechanism.

FIG. 14C shows a link mechanism. A loose hole 80 is drilled at the end of a link 70 on the foot-front nozzle 30 side, while a projection 81 fitted in this loose hole 80 is projected on the end of the shaft 33. With rotation of the motor 21, the projection 81 slides from the end to the end of the loose hole 80, and the foot-front nozzle 30 oscillates within this section.

In the case as shown in FIG. 14, the rotating operation of the foot-front nozzle 30 is performed purely mechanically, which eliminates the need of switches and the like. However, for those requiring change in the flow rate in the process of rotational movement, switches for position detection will be needed.

Figure 15A:
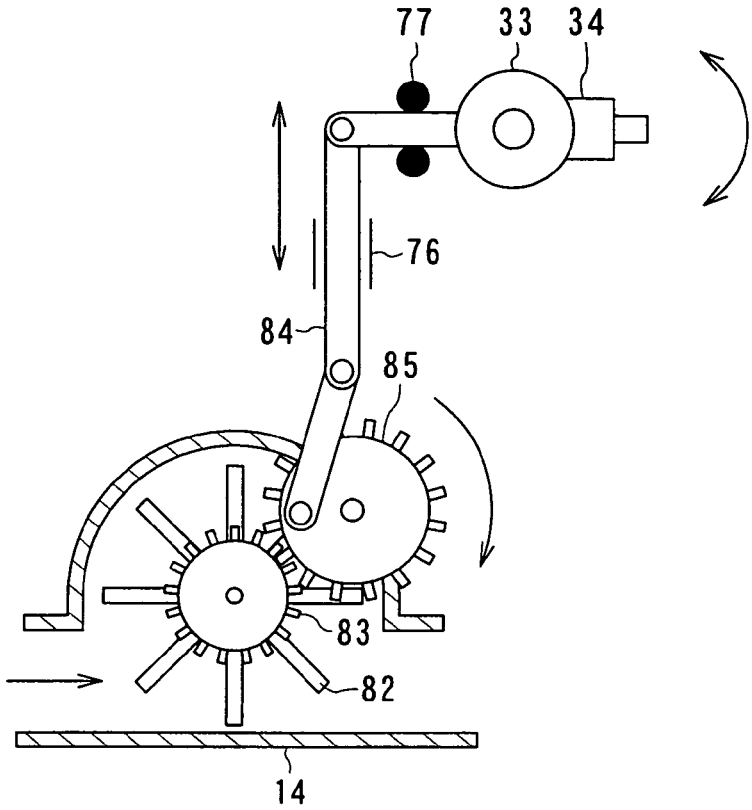
FIG. 15A shows a longitudinal sectional view and FIG. 15B shows a lateral sectional view.
Figure 15B:
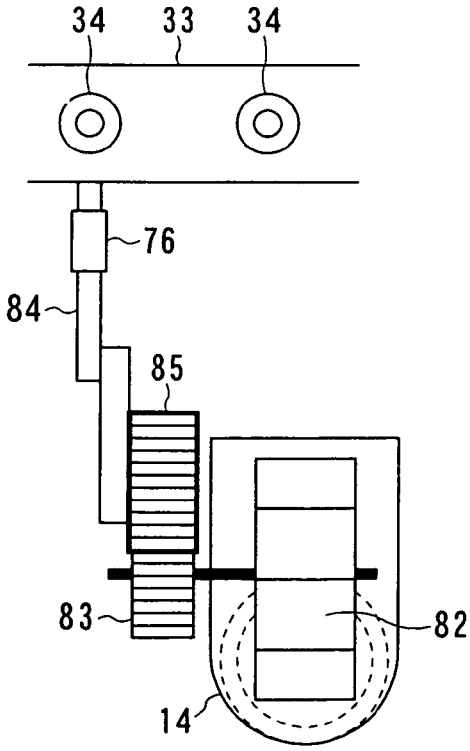

Moreover, an example in which electric power is not used as the water-spouting section direction moving mechanism 20 is shown in FIG. 15. In this example, a part in the water pipe 14 is swollen, where a water mill 82 having a gear 83 on its side face is provided, and the gear 83 is meshed with a gear 85 to which a crank 84 is connected so that the crank 84 is made to slide by a water flow instead of the motor 21.

In this preferred embodiment, a method for controlling an opening degree of the electromagnetic valve is used to control the flow rate, but flow rate control is not limited to this but can be made by switching voltage of a lifting pump or coiling tap. Alternatively, it may be so constituted that the flow rate is controlled by switching between water-spouting from all the nozzle units 34 and closure of some of the nozzle units 34. By switching the water-spouting pressure of the pump in this way, the water-spouting pressure of the sole and the foot-front nozzles can be varied at the same time.

Figure 16:
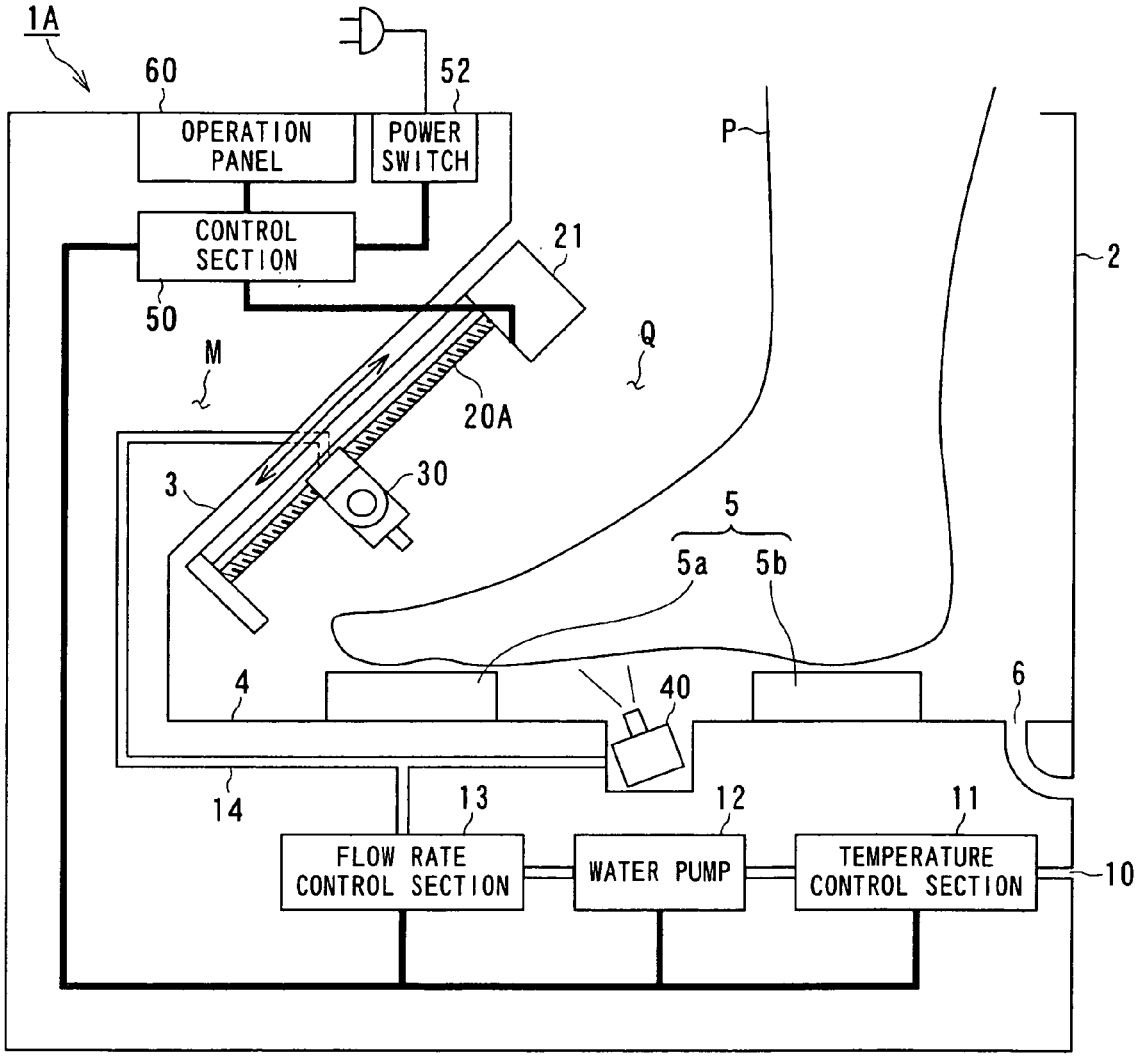
FIG. 16 is a view showing an outline of an entire construction of the leg water-spouting device according to a second preferred embodiment.

Next, a second preferred embodiment of the leg water-spouting device according to the present invention will be described referring to the figures. A leg water-spouting device 1A of this preferred embodiment is, as shown in FIG. 16, substantially different from the first preferred embodiment employing the rotational movement method in the point that a slide method is employed as the water-spouting section direction moving mechanism 20, with the other constructions being substantially the same as those of the first preferred embodiment, and the same reference numerals are given and the explanation will be omitted.

Figure 17:
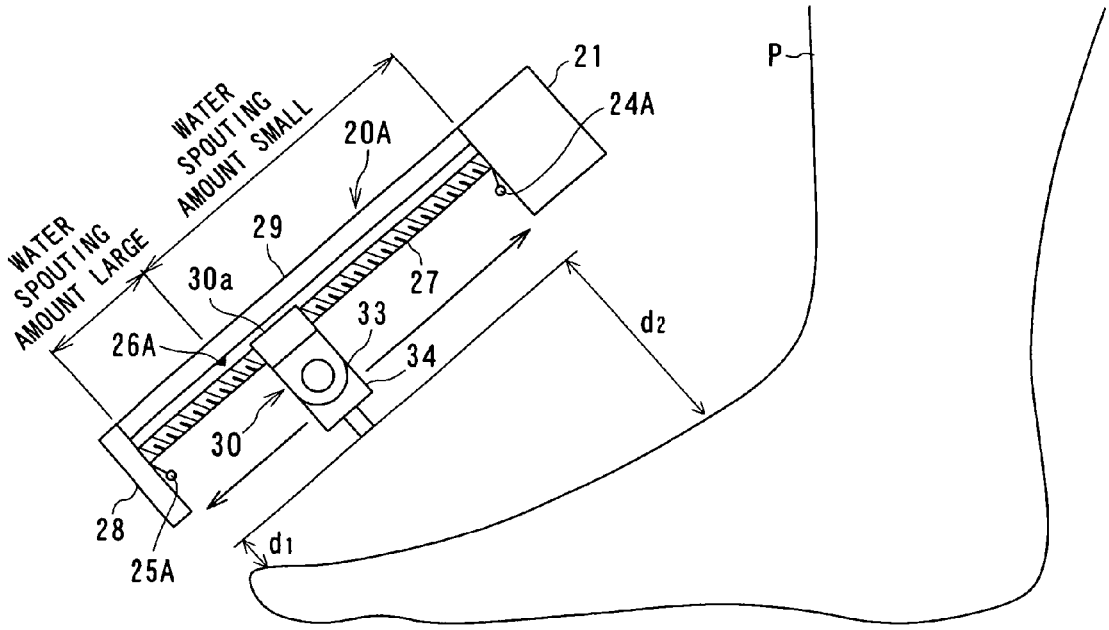
FIG. 17 is a schematic view showing a ball-screw slider mechanism, which is the water-spouting section direction moving mechanism according to the second preferred embodiment.

The water-spouting section direction moving mechanism 20 is constituted as a slider mechanism comprising, as schematically shown in FIG. 17, the motor 21 for move for vertically sliding the foot-front nozzle 30, a ball screw 27 directly connected to the rotary shaft of this motor 21, the foot-front nozzle 30 externally inserted to this ball screw capable of sliding, a stopper 28 for fixing the other end of this ball screw 27, and a guide 29 for connecting the motor 21 and the stopper 28.

The motor 21 for movement is a motor which can be rotated in both the forward/backward directions such as a stepping motor, a servo motor, a reversible motor, etc.

In the foot-front nozzle 30, a bonding section 30*a* with a water-spouting section direction moving mechanism 20A is mounted on the back face of the shaft 33 provided with the nozzle unit 34. In this bonding section 30*a*, a hole with a female thread is drilled, and this hole is externally screwed together with the ball screw 27. Moreover, the guide 29 also serves to prevent rotation of this foot-front nozzle 30 around the ball screw 27.

The ball-screw slider mechanism is further provided with switches 24A, 25A at the ends of the motor 21 and the stopper 28 opposed to the foot-front nozzle 30. The switches 24A, 25A output an electric signal indicating the current position of the foot-front nozzle 30 to the microcomputer 52 of the control section 50 by being turned ON. The microcomputer 52, upon receipt of this ON signal, gives an instruction to reverse the rotation to the motor 21. By this, the foot-front nozzle 30 repeats reciprocating movement between the motor 21 and the stopper 28.

Moreover, the ball-screw slider mechanism is provided with a switch 26A at a predetermined position of the guide 29 opposed to the foot-front nozzle 30. When the switch 26A detects passage of the foot-front nozzle 30 in the vicinity thereof, it sends an ON signal to the microcomputer 52 of the control section 50.

The microcomputer 52, upon receipt of this ON signal, gives an instruction to increase the flow rate to the flow rate control section 30 when the foot-front nozzle 30 slides from the ankle side to the tiptoe side, while when the foot-front nozzle 30 slides from the tiptoe side to the ankle side, it gives an instruction to decrease the flow rate to the flow rate control section 13. In this way, the microcomputer 52 alternately sends instructions for increase/decrease of the flow rate to the flow rate control section every time it receives the ON signal from the switch 26A. By this, at the tiptoe where the receptors concentrate, stimulation to the receptors is enhanced by the increase of flow rate so that more receptors can react.

In the leg water-spouting device 1A according to this preferred embodiment, too, by changing the program stored in the memory of the microcomputer 52, different operation can be effected. For example, it is possible to stop water spouting while the nozzle is moving from the ankle side to the tiptoe side or a program may be loaded that that movement is stopped at a certain position and after water is spouted in the concentrated manner at the portion for a certain period of time, instruction shall be given to resume the movement. Alternatively, it is possible to reciprocate between the tiptoe and the root of the fifth toe and to stop water spouting at both ends. Moreover, the rotating speed of the foot-front nozzle 30 may be changed or that may be selected from a plurality of programs.

Moreover, in this preferred embodiment, the flow rate is changed for the case where the foot-front nozzle 30 spouts water to the tiptoe side and the case where it spouts water to the ankle side, but it is possible to constitute so that the flow rate is fluctuated cyclically or at random, irrespective of the water-spouting destination. Alternatively, the water-spouting amount may be changed according to the position of the water arriving points by alternately providing an area with a large water-spouting amount and another area with a smaller water-spouting amount. By this change of water spouting form, complicated skin feeling can be also realized and adaptation can be prevented. Moreover, since the sole nozzle 40 and the foot-front nozzle 30 both use the common flow rate control section 13, the flow rate on the foot-front side is changed at the same time as the flow rate on the sole side, and diversified stimulation can be also applied to the sole.

The switch 26A may be proximity sensors, photoelectric sensors, limit switches or the like, for example. Though control by the microcomputer 52 is shown in this preferred embodiment, the control may be made by a sequencer.

This ball-screw slider mechanism is installed, as shown in FIG. 17, on the container body 2 with inclination so that a distance d1 from the tip end of the nozzle unit 34 to the water arriving point in the vicinity of the tiptoe is gradually reduced from a distance d2 in the vicinity of the ankle. Therefore, at water spouting to the tiptoe side, the water is spouted from the nearby position, and the pressure applied to the receptors at the tiptoe, that is, stimulation becomes relatively large. On the other hand, when spouting water to the ankle side, the water is spouted from the far position, and the pressure applied to the receptors at the ankle is relatively small. By this, larger stimulation can be applied to a portion where the receptors concentrate, while the stimulation is weakened when spouting water to the other portions to prevent adaptation.

The water-spouting section direction moving mechanism 20A is not limited to this ball-screw slider mechanism but can be constructed with various mechanisms. Some variations will be described below.

Figure 18A:
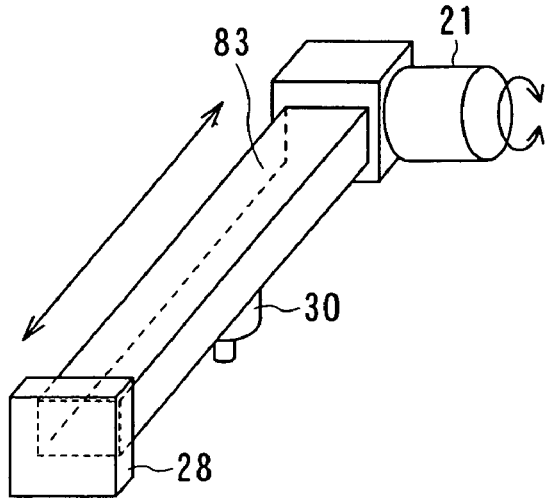
FIG. 18A shows a belt slider mechanism.

FIG. 18A shows an example using the belt 83 instead of the ball screw 27 of this preferred embodiment. By this, the foot-front nozzle 30 fixed to this belt 83 can reciprocate between the motor 21 and the stopper 28.

Figure 18B:
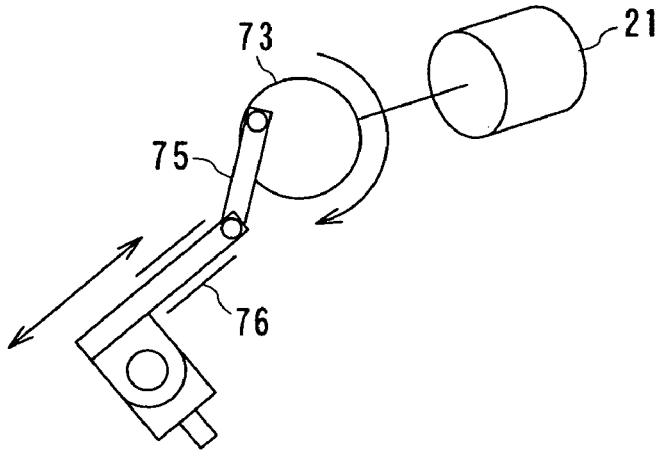
FIG. 18B shows a slider crank mechanism.

FIG. 18B shows a slider crank mechanism using a crank instead of the ball screw 27 of this preferred embodiment. The crank 75 is guided by the guide 76 and expanded/contracted, and the foot-front nozzle 30 can slide only by a diameter of the drum 73. In this case, the cam 23 may be provided either on the drum 73 on the motor 21 side or on the shaft 33 side.

Figure 18C:
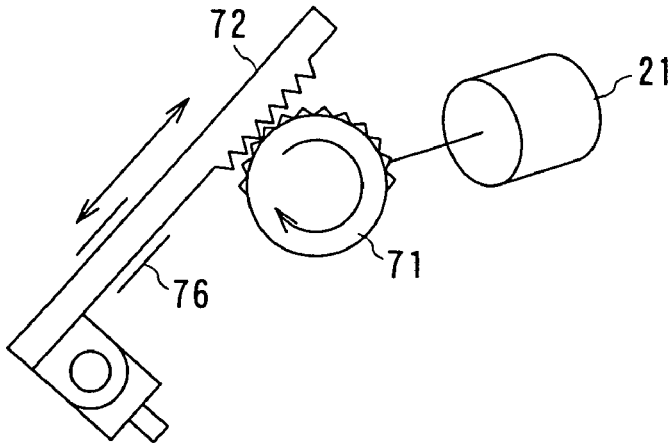
FIG. 18C shows a gear slide mechanism.

FIG. 18C shows a gear slide mechanism. While teeth provided at a part of the gear 71 is meshed with teeth provided at a part of a slide bar 78, the slide bar 78 slides upward with rotation of the gear 71, and the foot-front nozzle 30 is also moved upward. On the other hand, when the slide bar 78 has fully risen and the teeth on the gear 71 is not meshed with the teeth on the slide bar 78 any more, the slide bar 78 slides down by its own weight along the guide 76, and the foot-front nozzle 30 is also moved downward.

In FIGS. 18B and 18C, a DC brushless motor or the like which can not be rotated backward may be used as the motor 21 for move. In this case, the sliding operation of the foot-front nozzle 30 is performed purely mechanically, which eliminates the need of switches and the like. However, for those requiring change in the flow rate in the process of rotational movement, switches for position detection will be needed.

Figure 19A:
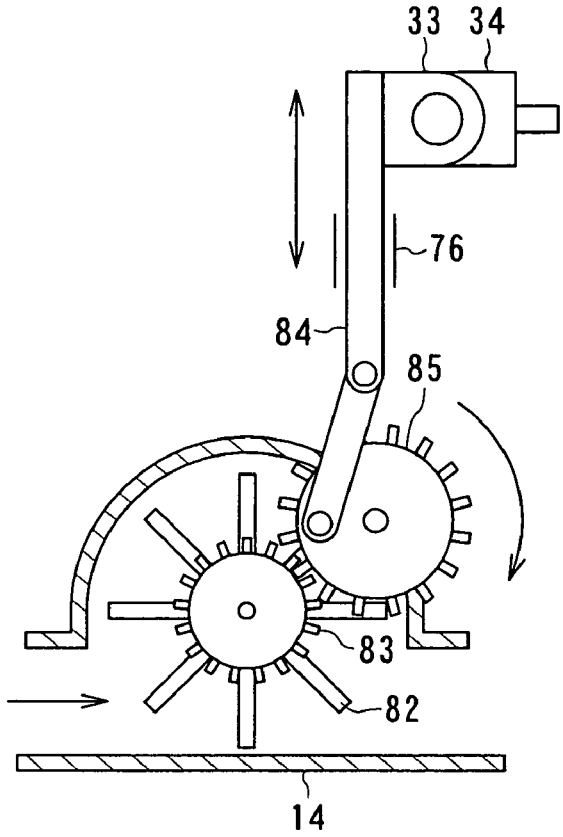
FIG. 19A shows a longitudinal sectional view and FIG. 19B shows a lateral sectional view.
Figure 19B:
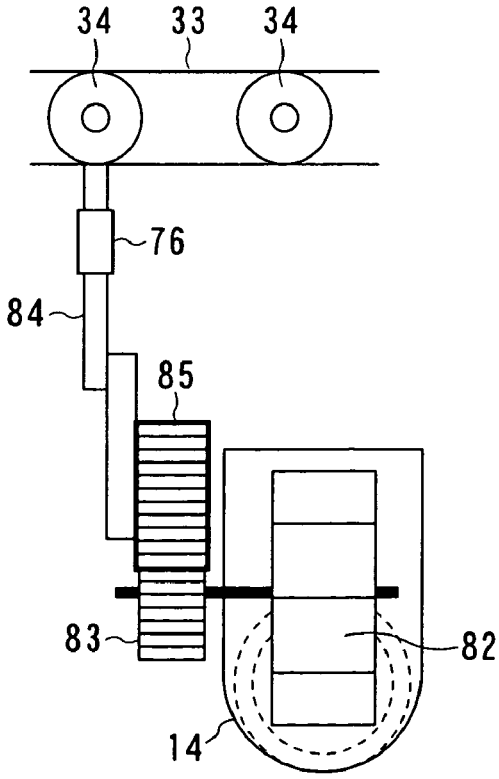

Moreover, an example in which electric power is not used as the water-spouting section direction moving mechanism 20A is shown in FIG. 19. In this example, a part in the water pipe 14 is swollen, where the water mill 82 having the gear 83 on its side face is provided, and the gear 83 is meshed with the gear 85 to which the crank 84 is connected so that the crank 84 is made to slide by a water flow instead of the motor 21.

Figure 20:
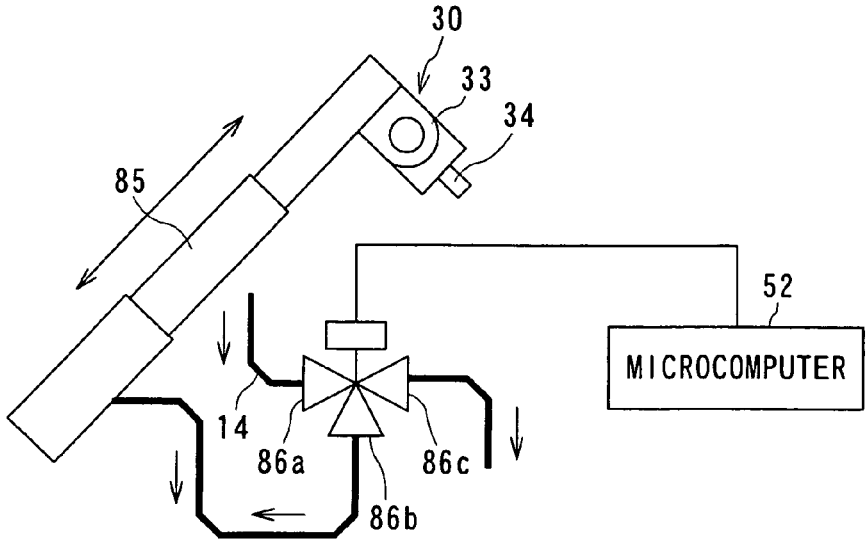
FIG. 20 is a view for explaining a water-pressure driving mechanism as a variation of the water-spouting section direction moving mechanism according to the second preferred embodiment, not driven by electric power.

A hydraulic driving mechanism as another example of the water-spouting section directing moving mechanism 20A using hydraulic power is schematically shown in FIG. 20. In this example, the foot-front nozzle 30 is supported by the multi-stage cylinder 85 which can be expanded/contracted, and in this cylinder 85, water from the water pipe 14 is filled through an electromagnetic three-way valve 86. This electromagnetic three-way valve 86 has a water-supply side valve 86*a*, a cylinder side valve 86*b*, and a drain side valve 86*c*.

When the foot-front nozzle 30 is to be raised, the water-supply side valve 86*a* and the cylinder side valve 86*b* are opened according to instruction of the microcomputer 52, while the drain side valve 86*c* is closed. At this time, the foot-front nozzle 30 is pushed by the pressure of water filled in the cylinder 86. On the other hand, when the foot-front nozzle 30 is to be lowered, the drain side valve 86*c* and the cylinder side valve 86*b* are opened according to the instruction of the microcomputer 52, while the water-supply side valve 86*a* is closed. At this time, the water in the cylinder 85 is drained by the own weight of the foot-front nozzle 30, and the foot-front nozzle 30 is lowered.

Next, a third preferred embodiment of the leg water-spouting device according to the present invention will be described referring to the attached drawings. While the above-mentioned two preferred embodiments conceptually describe the essential part of the present invention, this preferred embodiment includes elements eliminated in the above preferred embodiments and is more specific.

Figure 23A:
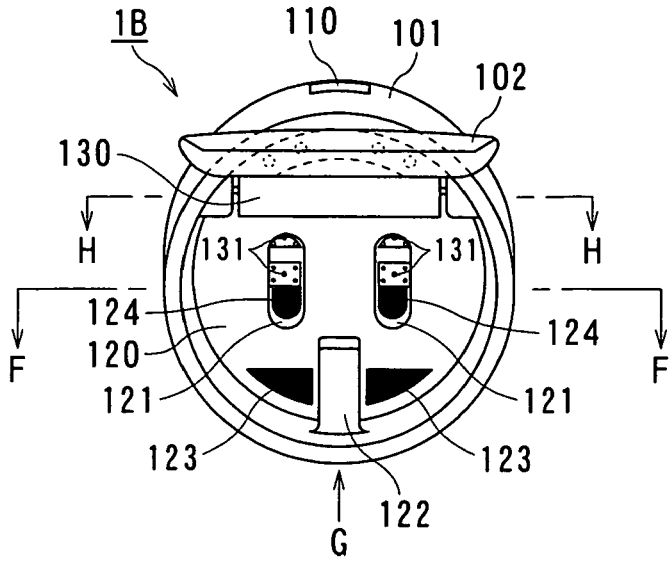
FIG. 23A is a plan view.
Figure 23B:
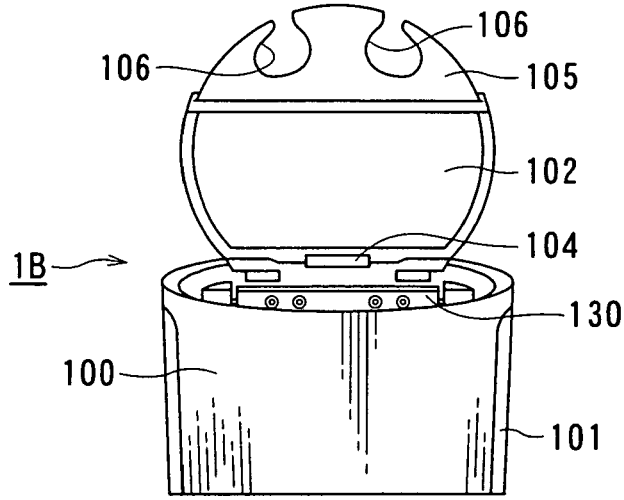
FIG. 23B is a front view and FIG. 23C is a right side view.
Figure 23C:
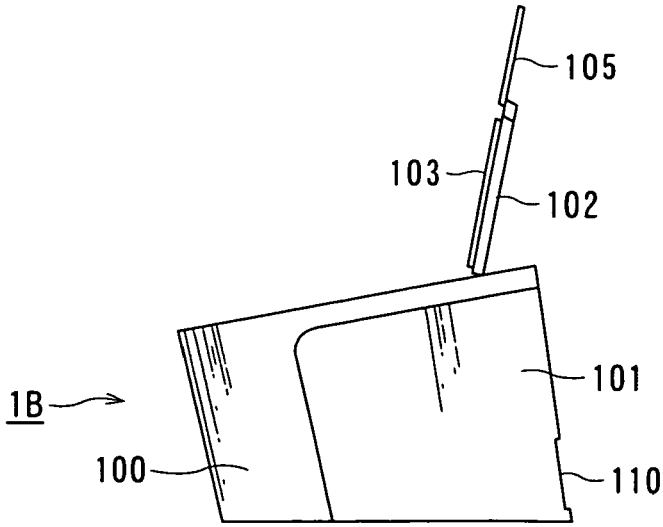

A leg water-spouting device 1B according to this preferred embodiment presents, as shown in FIGS. 22 and 23, a cylindrical appearance inclined toward the front side by about 10 degrees. Here, when the user inserts the foot, the direction of the heel of the user is referred to as "front", while the direction of the tiptoe of the user is referred to as "back".

In the leg water-spouting device 1B, a detachable rear cover is mounted to the back face side of a container body 100 forming the upper face and the front face so that internal inspection can be conducted. A approximately rectangular opening is formed at the lower part at the center on the back face of this rear cover 101, and a back-face plate 110 fixed to the container body 100 is exposed. This back-face plate 110 is provided with a drain outlet 11, a power cord 112 and a power switch 113.

Figure 24A:
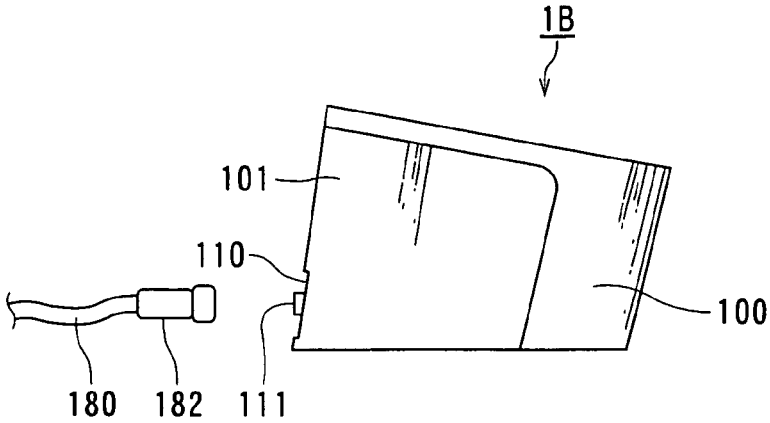
FIG. 24A shows connection with a hose and FIG. 24B shows connection with a tank through a one-touch joint.
Figure 24B:
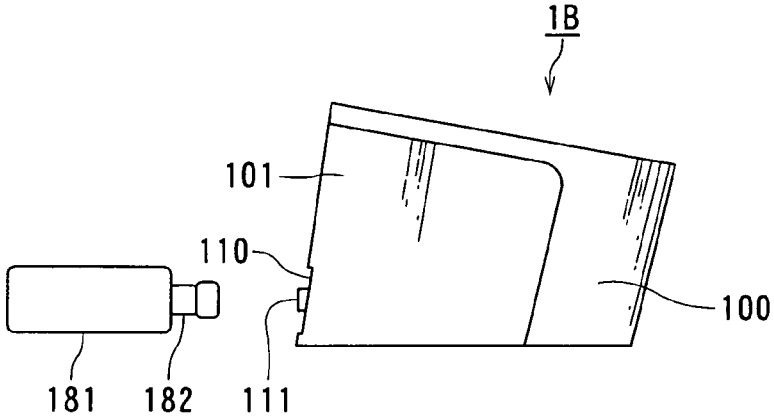

To this drain outlet 11, a water drain hose 180 as shown in FIG. 24A or a water drain tank 181 as shown in FIG. 24B is connected, when used water is to be drained to the outside.

This connection is effected through a one-touch joint 182 having a locking mechanism for connecting the water drain hose 180 or the water drain tank 181 not capable of being withdrawn, an unlocking mechanism for releasing the locking mechanism, and a water stop mechanism for preventing water leakage from the drain outlet 111 when the unlocking mechanism is operated. By this, even if the water drain hose 180 or the water drain tank 181 is removed, water will not leak from the drain outlet 111, and the leg water-spouting device 1B does not have to be moved or raised at drainage. Also, the obtrusive water drain hose 180 and the like can be removed except at drainage. The water drain tank 181 can be used not only at the drainage but also for water supply to the leg water-spouting device 1B.

On the back-face side of the upper face, an operation panel 170 for instructing desired operation to the leg water-spouting device 1B is fixed, and the remaining portion occupying the majority of the upper face is formed as an opening for accommodating the foot of the user. In this opening, an upper-face cover 102 and a water-splash prevention section 105 are provided to prevent splash of hot water in use.

Figure 25:
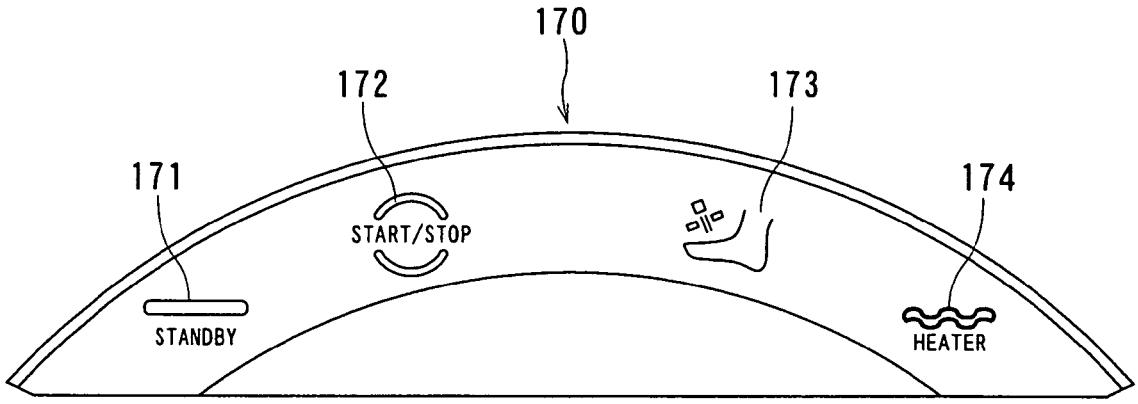
FIG. 25 is a view showing an operation panel of the leg water-spouting device according to the third preferred embodiment.

The operation panel 170 is provided with, as shown in FIG. 25, a standby LED 171 to notify that a water amount required for water spouting is reached, a start/stop switch 172 for instructing start/stop of water spouting, a toe nozzle move switch 173 for instructing start/stop of rotational movement of a toe water-spouting nozzle unit 130, which will be described later, and a heater ON/OFF switch 174 for controlling the water temperature of the spouting water.

Figure 26:
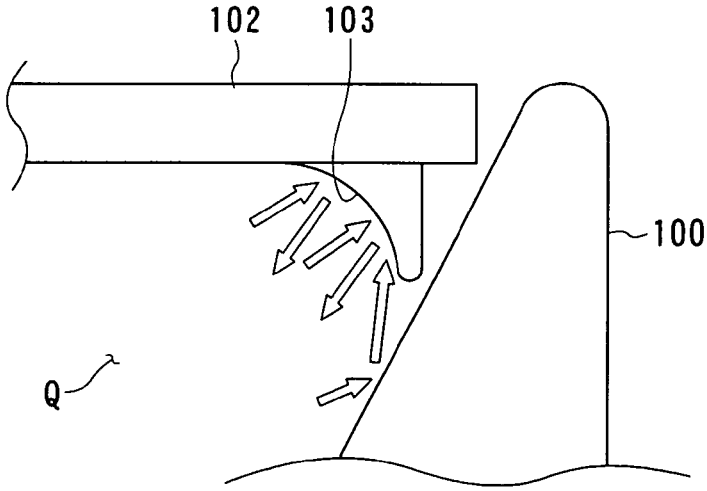
FIG. 26 is an A-A sectional view of FIG. 22.

Here, as shown in FIGS. 22 and 23, the upper-face cover 102 covers more than two thirds of the opening and is pivotally supported on the back-face side of the container body 100 capable of rotational movement through a hinge 104. This upper-face cover 102 has a weight to an extent not to be floated by splashing water and is formed by a colored or non-colored transparent material, such as an acrylic plate with some thickness or the like, so that the state inside the foot accommodation portion can be seen from the outside. On the lower face at the outer edge of this upper-face cover 102, as shown in FIG. 26, a water return 103 is projected to ensure prevention of splash of water to the outside.

The water-splash prevention section 105 covering the front side of the upper face is attached to the upper-face cover 102 and has two foot insertion sections 106, 106. The foot insertion section 106 is formed by a material with rich flexibility such as rubber and sponge so that it is pushed open and is brought into close contact with the inserted leg when the user inserts his leg. Considering feeling against the skin, a material for a wet suit used during diving is suitable.

The bottom surface of the opening serves as a foot rest 120 on which the user places the foot, and as shown in FIG. 23A, two foot-rest openings 121, 121 are drilled in the right and left symmetrical manner at the center in the longitudinal direction, and a foot position guide 122 is set up for guiding positioning of the right and left feet at the center on the front side. Also, in the right and left of the foot position guide 122, first strainers 123, 123 for returning spouted water to a circulation pump 134, which will be described later, are provided. This first strainer 123 is formed in a mesh of 1 mm, for example, when the diameter of the water spouting nozzle is 1.5 mm, so that small rubbish, lint or the like having slipped into the leg accommodation space Q does not clog the water spouting nozzle via the circulation pump.

At the lower part of the foot-rest openings 121, sole water-spouting nozzles 131, 131 and second strainers 124 are provided with a certain distance from the soles. In this preferred embodiment, two sole water-spouting nozzles are provided for each of the right and left soles, but the number of the nozzles may be one. The second strainer 124 is formed in the mesh form similarly to the first strainer 123 so as to return spouting water flown from the foot-rest opening 121 to the circulation pump 134 while removing rubbish, lint or the like.

Figure 27:
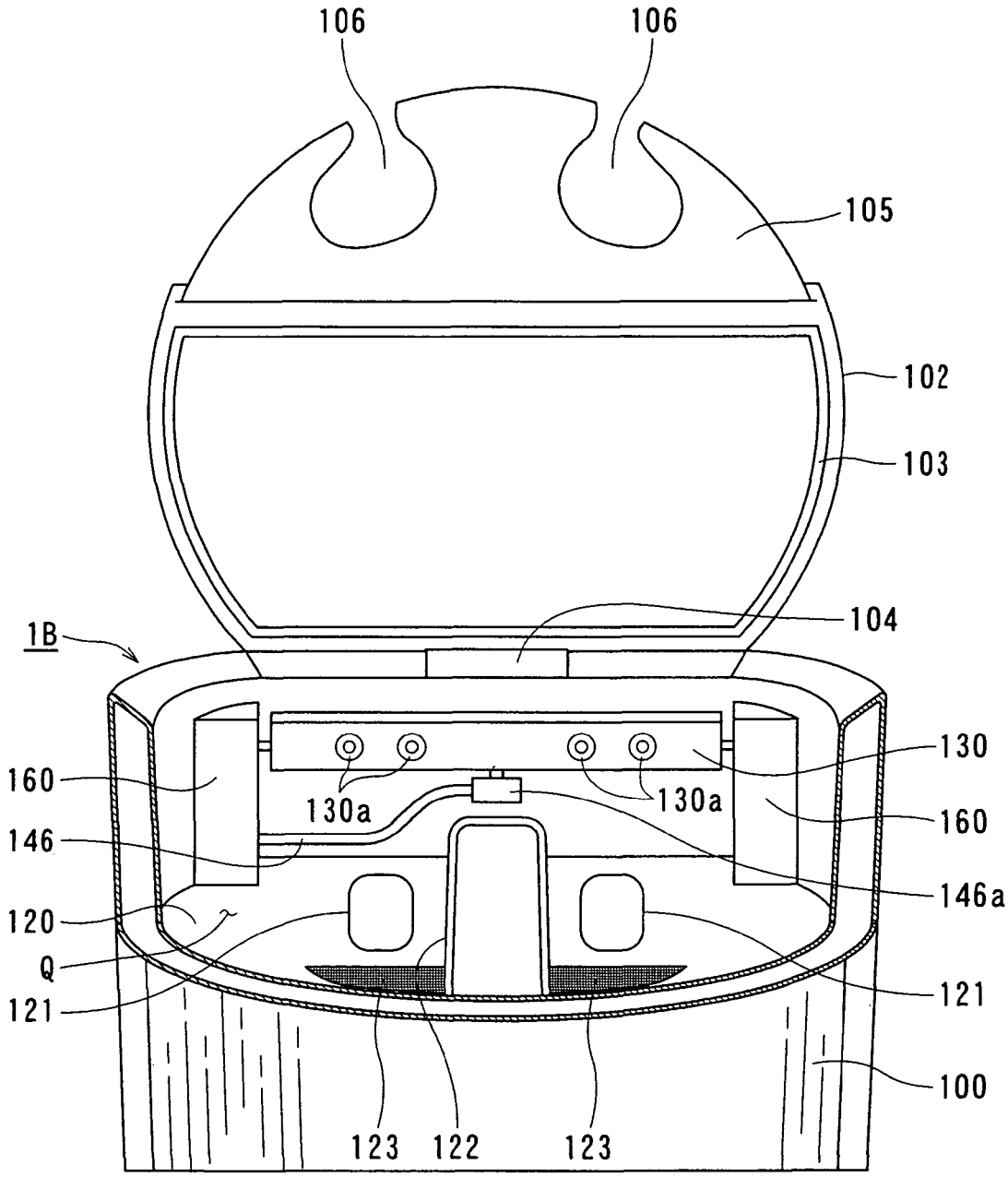
FIG. 27 is an F-F view on arrow of FIG. 23.

Immediately below the operation panel 170, as shown in FIG. 27, the toe water-spouting nozzle unit 130 is horizontally extended between support tables 160, 160 installed upright in the approximately triangular prism shape. One end of the toe water-spouting nozzle unit 130 is connected to a driving motor installed in the support table 160 so that the toe water-spouting nozzle unit 130 is made rotatable electrically.

Also, a toe water-spouting nozzle unit piping 146 for supplying water to this toe water-spouting nozzle unit 130 is taken out of the side face of the foot rest 120 in one of the support tables 160 and connected to the center of the toe water-spouting nozzle unit 130 through a feed water adapter 146*a*. A portion of the toe water-spouting nozzle unit piping 146 exposed at least on the foot rest 120 is formed by a flexible material such as a silicon hose, for example, so that the rotational movement of the toe water-spouting nozzle unit 130 can be followed. In this way, by connecting it to the center of the toe water-spouting nozzle unit 130 and branching, the water pressure spouted from the right and the left nozzles can be made even.

Figure 28A:
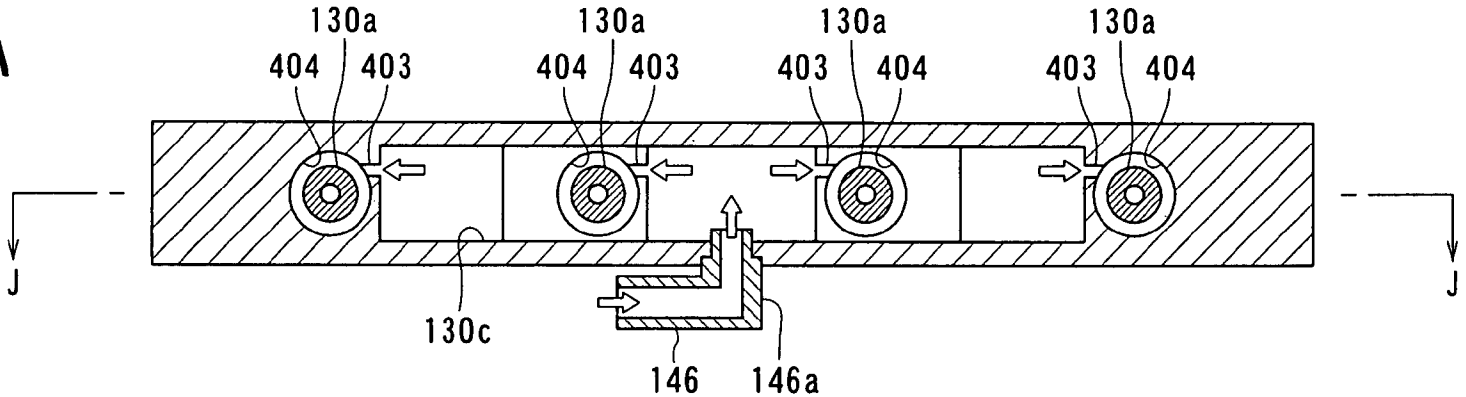
FIG. 28A is a schematic H-H view on arrow of FIG. 23
Figure 28B:
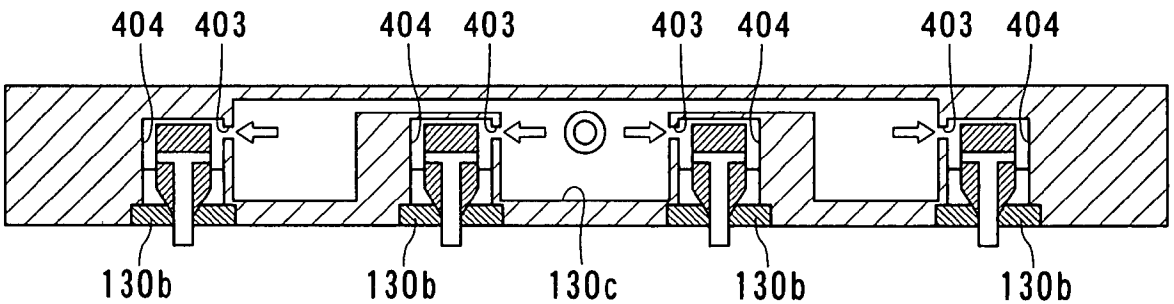
FIG. 28B is a schematic J-J view on arrow of FIG. 28A.

The inside of the toe water-spouting nozzle unit 130 is shown in FIG. 28. The toe water-spouting nozzle unit 130 is provided with two right and left nozzles 130*a* and a water pipe 130*c* for connecting them, respectively. These nozzles 130*a* are capped by a nozzle cap 130*b* and loosely inserted into the swirl chamber 404. And they are connected to the water pipe 130*c* via the swirl chamber inlet passage 403. The respective nozzles 130*a* are constructed similarly to the sole nozzle 40 in the first preferred embodiment, and the same reference numerals are given and detailed description will be omitted.

Therefore, the nozzle 130*a* is rotated by a water flow generated by the circulation pump 134, made into a trajectory of revolving water spouting in the conical state and can spout water in a wide range. Thus, even though the number of the nozzles 130*a* is two for right and left each, water spouting in the range equivalent to that with 4 nozzles as in the foot-front nozzle 30 in the first preferred embodiment can be realized. Also, since the water spouting destination is rotationally moved not only in the longitudinal direction of a foot but also oscillated in the horizontal direction, more complicated sense feeling can be obtained, and adaptation can be prevented. Moreover, such a problem is solved that, if the number of the nozzles 130*a* is increased, the water pressure per nozzle is lowered and sufficient satisfaction might not be obtained.

The appearance and the leg accommodation space Q of the leg water-spouting device 1B according to this preferred embodiment, that is, the portion normally seen by the user is as mentioned above, and next, the device essential parts normally not seen by the user will be described. FIG. 29 is a view showing the device essential part after the rear cover 101 is removed.

Under the foot rest 120, a tank 132 for reserving water for spouting is provided. This tank 132 ensures sufficient height so that the circulation pump 134 does not catch air. The water reserved here is sucked into the circulation pump 134 via a pump suction pipe 142. At drainage, on the other hand, water is sent down the gradient of a drain pipe 147 to the drain outlet 111. If the water drain hose 180 and the like are not connected, the water stop mechanism of the one-touch joint 182 prevents leakage from the drain outlet 111.

Figure 30:
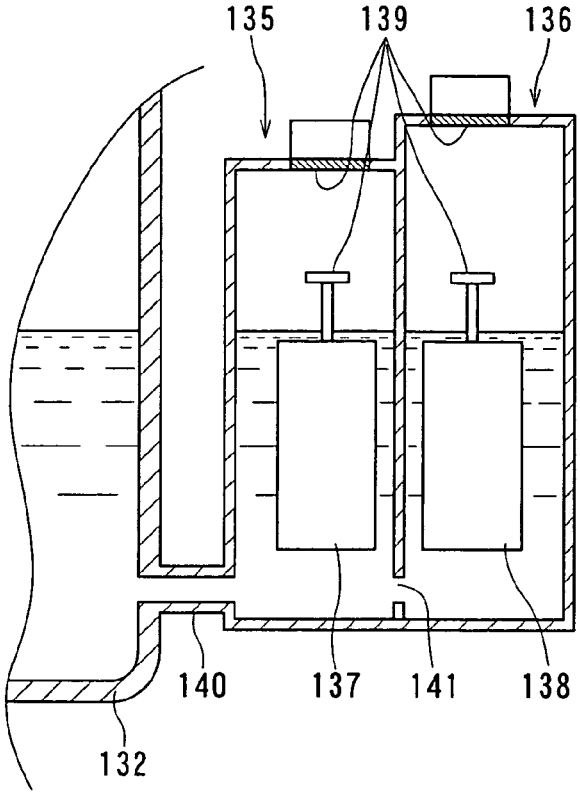
FIG. 30 is a view for explaining an outline construction of a water level detection sensor.

On the side face of the tank 132, the sole water-spouting nozzle 131 is arranged, and a lower water-level detection sensor 135 and an upper water-level detection sensor 136 are also installed. The lower water-level detection sensor 135 and the upper water-level detection sensor 136 are formed, as schematically shown in FIG. 30, into boxes with the top plates of different heights. They are made to communicate with the tank 132 and thus, the same water level as that in the tank 132 is maintained.

In the lower water-level detection sensor 135 and the upper water-level detection sensor 136, two floats with the same height: a lower water-level float 137 and an upper water-level float 138 are floated, respectively. This lower water-level float 137 is set to a height so that the minimum water amount required for circulation of spouting water is reserved, when the top portion is brought into contact with the top plate. Also, the upper water-level float 138 is set to a height so that the water amount required for start of use can be ensured when the top is brought into contact with the top plate.

The reason why such two-stage water level detection is provided is as follows. That is, at the first water reserving, the circulation pump 134 is not started and water does not prevail through the circulation pump 134 and the water-spouting nozzles. However, when use is started, water prevails through those portions and the water level in the tank 132 is lowered. Water circulation can be continued without air being caught in this state at the water level "that the minimum water amount required for circulation of spouting water can be reserved" and the water level before the drop of the level in the tank 132 is the water level "that the water amount required for start of use can be secured."

The lower faces of the top plates of the lower water-level detection sensor 135 and the upper water-level detection sensor 136 and the lower water-level float 137 and the upper water-level float 138 are provided with electrodes 139 in the mutually opposing manner.

When water is fed into the tank 132 and the water level is raised to a certain height, the electrodes 139 on the lower water-level switch 137 and the upper water-level switch 138 are brought into contact with the electrodes 139 on the lower water-level detection sensor 135 and the upper water-level detection sensor 136 on the top plate sides, and a detection signal is transmitted to a switch driver substrate 153.

In this way, since water-level measurement is conducted not in the tank 132 but by the lower water-level detection sensor 135 and the upper water-level detection sensor 136 provided separately, even if the water surface in the tank 132 is agitated by the water flow at the water feed or when the spouted water returns from the first strainer 123 and the second strainer 124 to the tank 132, for example, an error caused by the influence can be minimized as much as possible.

The circulation pump 135 mounted on a bottom plate 107 on its water supply side is connected to a branching unit 133, and the water sucked from the tank is branched to the left sole water-spouting nozzle piping 144 for feeding water to the left sole water-spouting nozzle, the right sole water-spouting nozzle piping 145 for feeding water to the right sole water-spouting nozzle and a toe water-spouting nozzle unit piping 146.

Figure 29A:
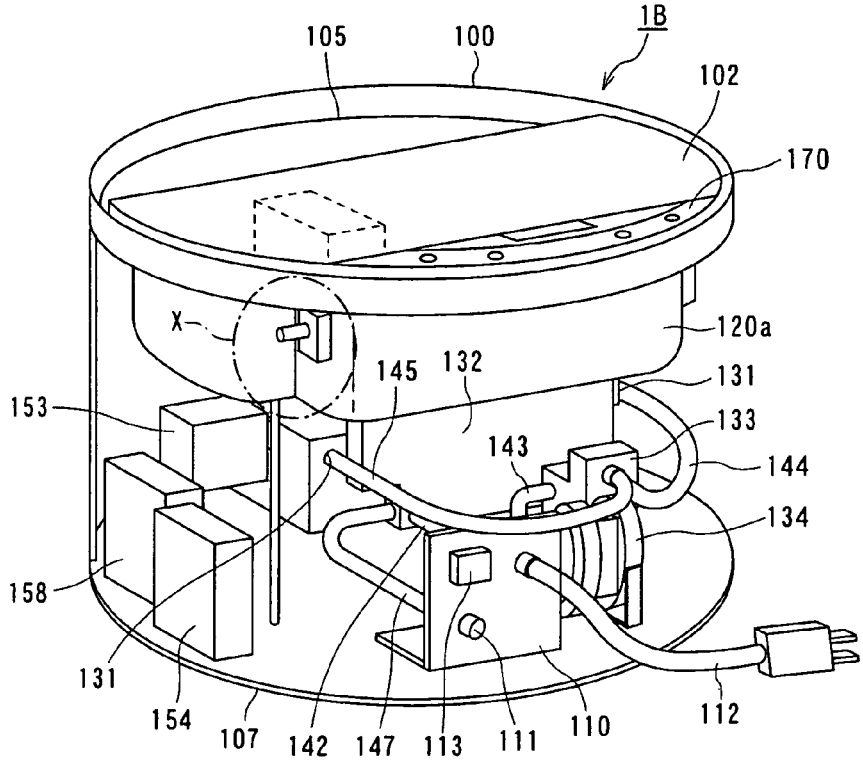
FIG. 29A is a view on arrow in B direction of FIG. 22
Figure 29B:
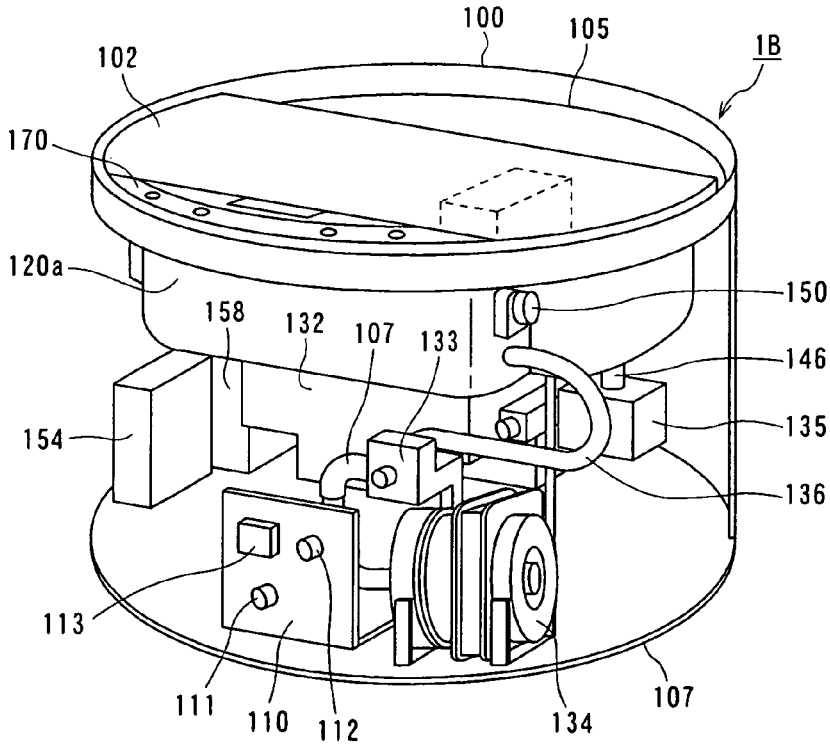
FIG. 29B is a view on arrow in C direction.
Figure 31:
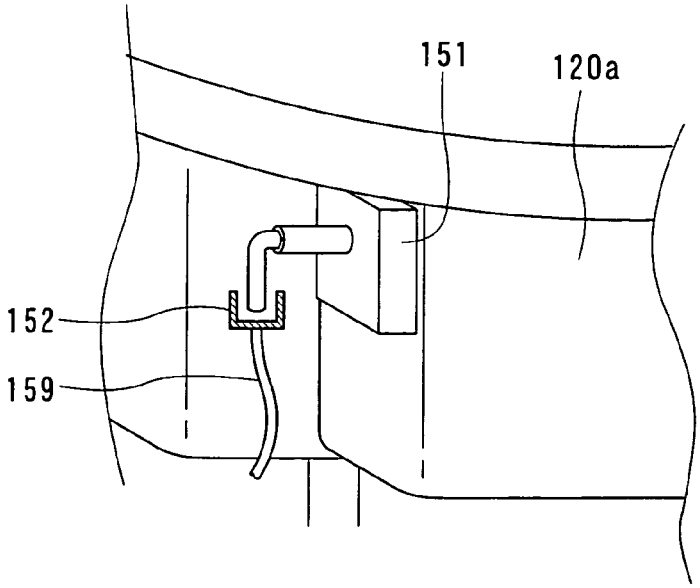
FIG. 31 is an enlarged view of X part in FIG. 28.

On the outer side face of the foot rest under one end of the operation panel 170, as shown in FIG. 29B, a driving motor 150 for rotationally moving the toe water-spouting nozzle unit 130 is mounted, while on the outer side face of the foot rest under the other end of the operation panel 170, as shown in X part in FIG. 29A and FIG. 31, a bearing 151 for pivotally supporting the toe water-spouting nozzle unit 130 is mounted.

As the driving motor 150, a motor which can be rotated in both the forward/backward directions such as a stepping motor, a servo motor, a reversible motor, etc, is directly connected to the toe water-spouting nozzle unit 130 in this preferred embodiment, but it may be connected through a gear as in the first preferred embodiment.

A position detection sensor 152 is provided in the vicinity of the bearing 151. Since this position detection sensor 152 is constructed similarly to the switch and the cam in the first preferred embodiment, the description will be omitted. A signal obtained by the position detection sensor 152 is transmitted to the motor driver substrate 153 for controlling the mode of the driving motor via a communication line 159.

Figure 32:
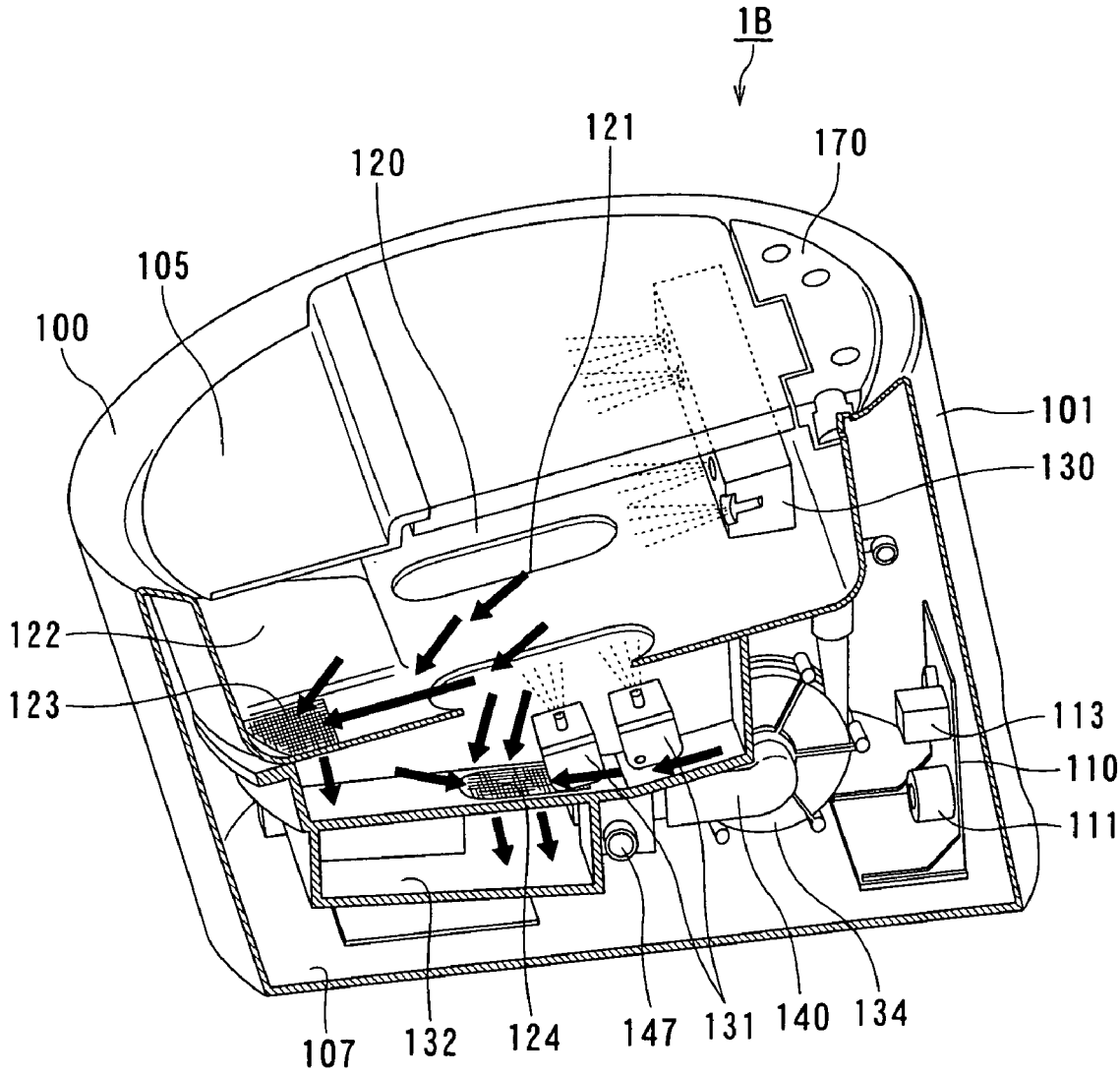
FIG. 32 is a perspective view of a D-D section in FIG. 22.

Next, referring to FIG. 32, water circulation in the leg water-spouting device 1B according to the preferred embodiment will be described. The user first supplies a required amount of water into the leg accommodation space Q using a basin or a PET bottle. Alternatively, the above-mentioned water drain tank 181 may be used. The water amount required for circulation is about 1.5 liter, and this feed water will not make a large burden for the user.

The water supplied to the leg accommodation space Q is reserved in the tank 132 through the first strainers 123 at the lowest part of the foot rest 120 and the second strainers 124 under the foot-rest openings 121. When the circulation pump 134 is driven at this time, the water in the tank 132 is sucked by the circulation pump 134, fed to the branching unit 133 provided at the outlet side of the circulation pump 134 and branched here to the left sole water-spouting nozzle piping 144, the right sole water-spouting nozzle piping 145 for feeding water to the right sole water-spouting nozzle and the toe water-spouting nozzle unit piping 146.

The left sole water-spouting nozzle 131, the right sole water-spouting nozzle 131 and the toe water-spouting nozzle unit 130 to which water is fed by the respective pipings start water spouting into the leg accommodation space Q. This water-spouting mechanism is the same as that in the leg water-spouting device 1 according to the first preferred embodiment, and the description will be omitted.

This spouted water is recovered by the tank 132 through the first strainers 123 and the second strainers 124 as at the first feed water, and this circulation is repeated thereafter.

Figure 33:
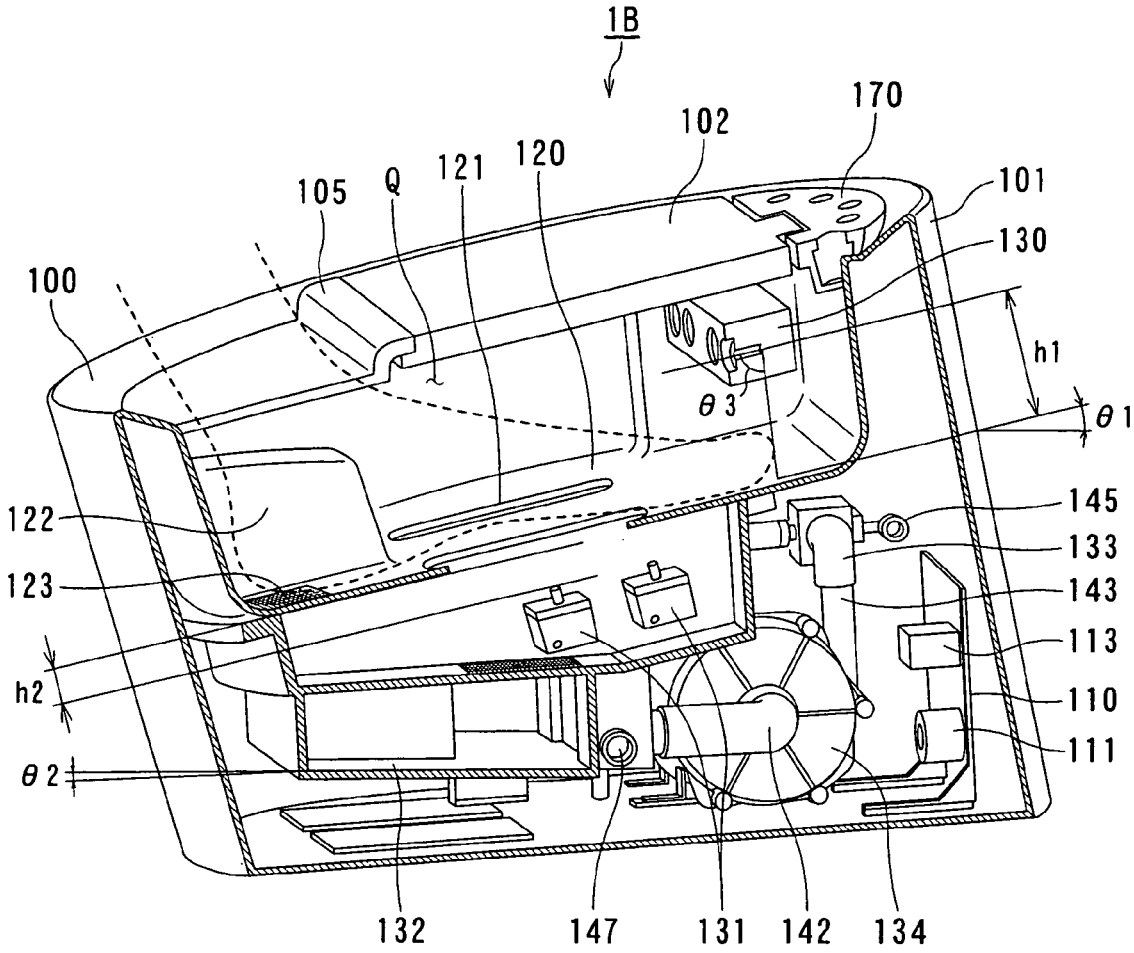
FIG. 33 is a schematic D-D sectional view of FIG. 22.

FIG. 33 is a view for explaining disposition relation of the respective components of the leg water-spouting device 1B. The foot rest 120 is laterally provided with a gradient θ1 inclined downward from the back face side to the front side. This is to efficiently collect water poured onto the foot rest 120 in the first strainer 123. This gradient θ1 is preferably approximately 10 degrees.

The toe water-spouting nozzle unit 130 is rotated in a range of 90 degrees from a position in parallel with the foot rest 120 to a position perpendicular to the foot rest 120. That is because, when water is spouted to above the position in parallel with the foot rest 120, a possibility of water leakage to the outside gets high, and there is a side face of the foot rest 120 immediately behind the back face of the toe water-spouting nozzle unit 130, and there is no chance that the toe is placed on the back face side from the position perpendicular to the foot rest 120.

Therefore, in order to spout water in a range from the toe to the ankle, a clearance h1 between the toe water-spouting nozzle unit 130 to the foot rest 120 is preferably not less than 85 mm.

A clearance h2 is secured between the tip end of the sole water-spouting nozzle 131 and the foot-rest opening 121. This is to effectively receive enlargement of the water-spouting range by rotary motion of the sole-water-spouting nozzle 131 and the clearance h2 is preferably not less than 30 mm.

The bottom surface of the tank 132 has a gradient θ2 inclined in the reverse direction to the foot rest 120, that is, downward from the front side to the back face side. By this, water is efficiently collected in a pump sucking pipe 142 and the drain pipe 147 connected to the lower end on the front side of the tank 132 so that no water remains inside after use. This gradient θ2 is preferably 5 degrees.

Moreover, the drain pipe 147 is laid with the similar gradient downward from the tank 132 side to the drain outlet 111. By this, if the water drain hose 180 is connected to the drain outlet 111 and the water stop mechanism is released, natural discharge can be performed without applying an external force.

Figure 34A:
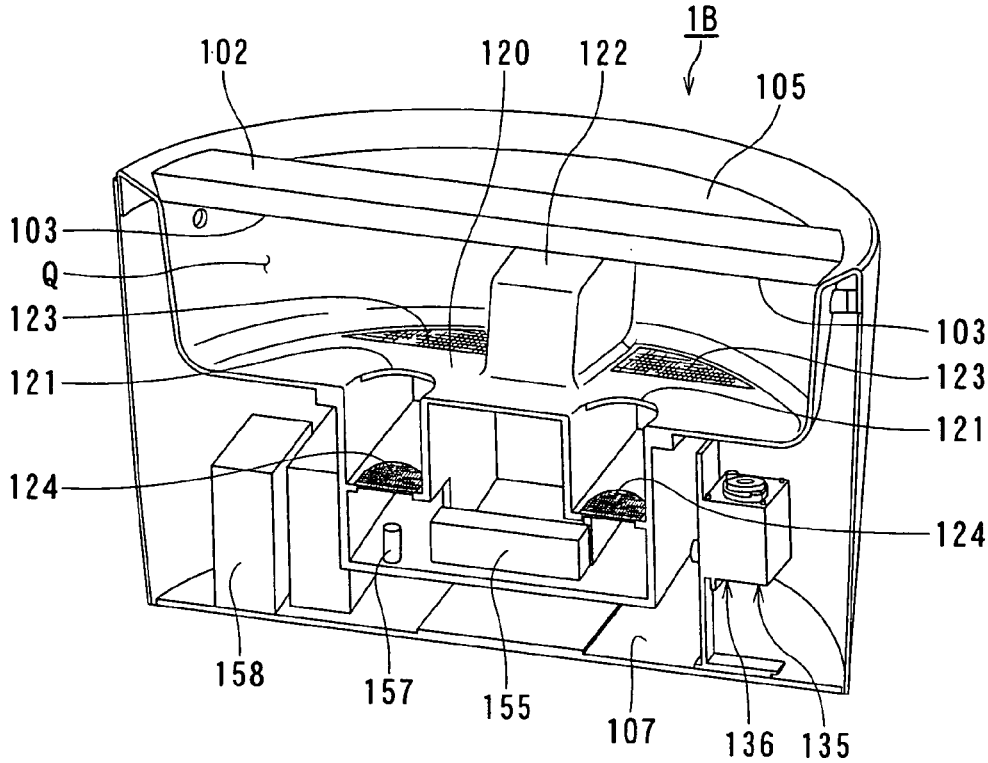
FIG. 34A is a perspective view of an E-E section.

The leg water-spouting device 1B is provided with a heating device for maintaining the water temperature in use. FIG. 34A shows an example of this heating device. In this example, a sheathed heater 155 and a thermister 157 for detecting the water temperature are provided in the tank 132, and ON/OFF of the sheathed heater 155 is controlled by a heater controller 158 according to the water temperature detected by the thermister 157.

Figure 34B:
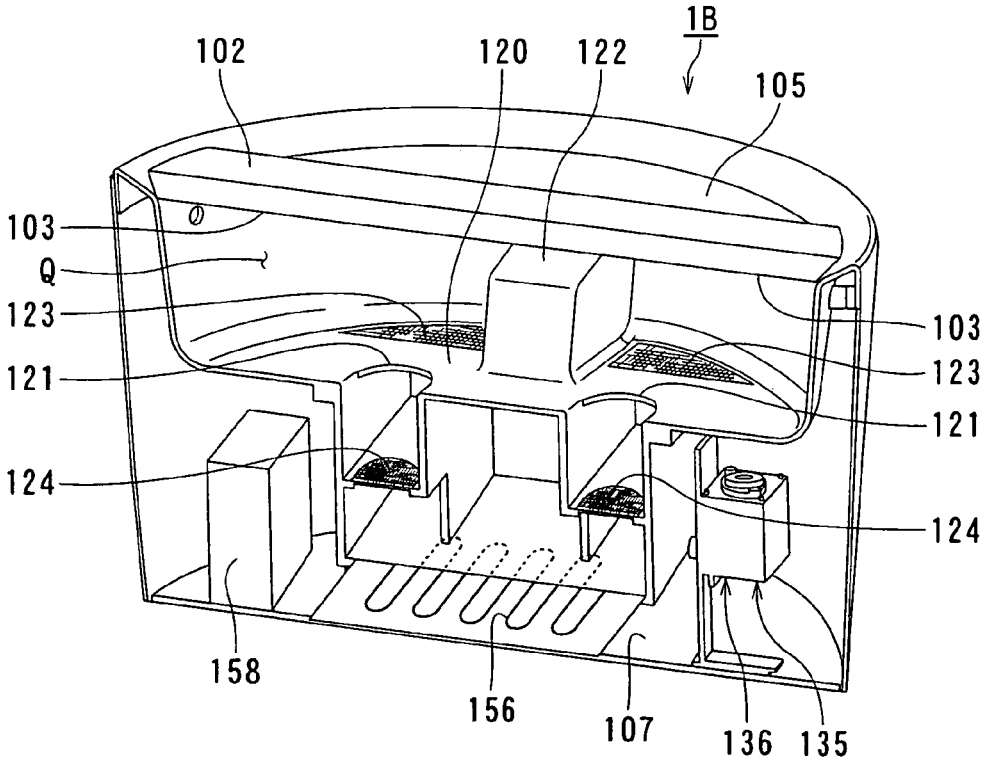
FIG. 34B is a view showing a variation of the heater.

The heating device can be, as shown in FIG. 34B, in a simple construction in which a heater coil 156 is bonded to the bottom surface and/or the outer circumference of the tank 132 by an aluminum tape or the like. According to this example, since the heater controller, the thermister, etc. are not needed, the heating device can be provided with a lower cost. In this case, since heating is continued while a heater ON/OFF switch 174 is ON, the length of the heater coil should be adjusted in advance to avoid overheating because of too high heating capability.

The leg water-spouting device 1B according to this preferred embodiment is constructed as above, and the usage will be described below.

Figure 35:
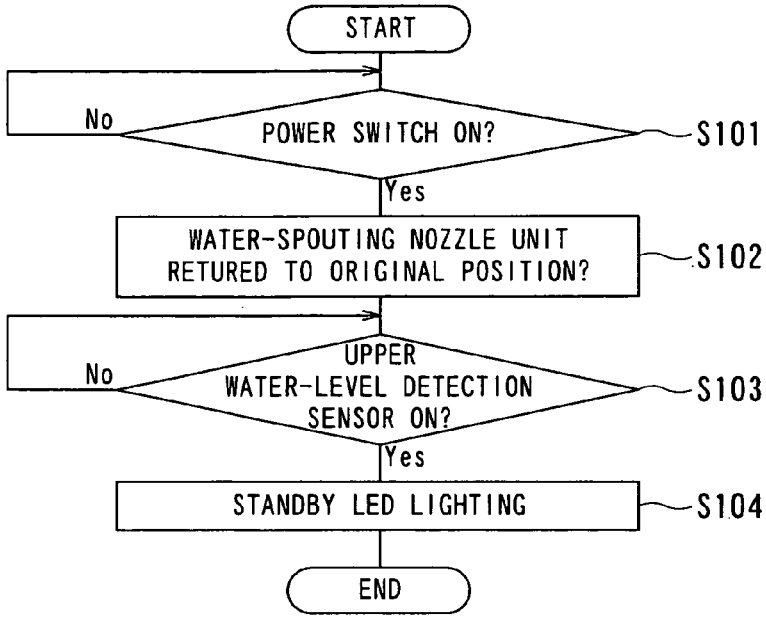
FIG. 35 is a flowchart explaining a flow of preparation operation.

FIG. 35 is a flowchart for explaining a flow of preparation at use. When the user connects the power cord 112 to an outlet to turn ON the power switch 113 (Step S101), the toe water-spouting nozzle unit 130 is returned to the origin position by an instruction of the motor driver substrate 154 (Step S102). The origin position is normally set at a position where the toe nozzle 130*a* is directed to the lowermost end, but it is not limited.

Then, the user starts water feed using a basin or the like into the leg accommodation space Q. The water flows into the tank 132, and when the water level in the tank 132 is raised to the height where a water amount required for start of use is ensured, the upper water-level float 138 reaches the electrode 139 and the upper water-level detection sensor 136 is turned ON (Step S103: Yes).

Here, the lower water-level detection sensor 135 has been already turned ON before the upper water-level detection sensor 136 is turned ON, that is, when the water level is lower than the water level that the upper water-level detection sensor 136 is turned ON. If the water level in the tank 132 becomes lower than the height where the minimum water amount required for circulation of spouting water is reserved for some reason, the lower water-level detection sensor 135 is brought from the ON state into the OFF state, and the signal is sent to the switch driver substrate 153. The switch driver substrate 153, upon receipt of this signal, sends a stop signal to the circulation pump 134 to stop the pump 134 and prevents idle operation of the circulation pump 134 due to lack of water amount.

The signal from the upper water-level detection sensor 136 is sent to the switch driver substrate 153, and the switch driver substrate 153 lights the standby LED 171 on the operation panel 170 to notify the user that preparation is completed (Step S104).

Figure 36:
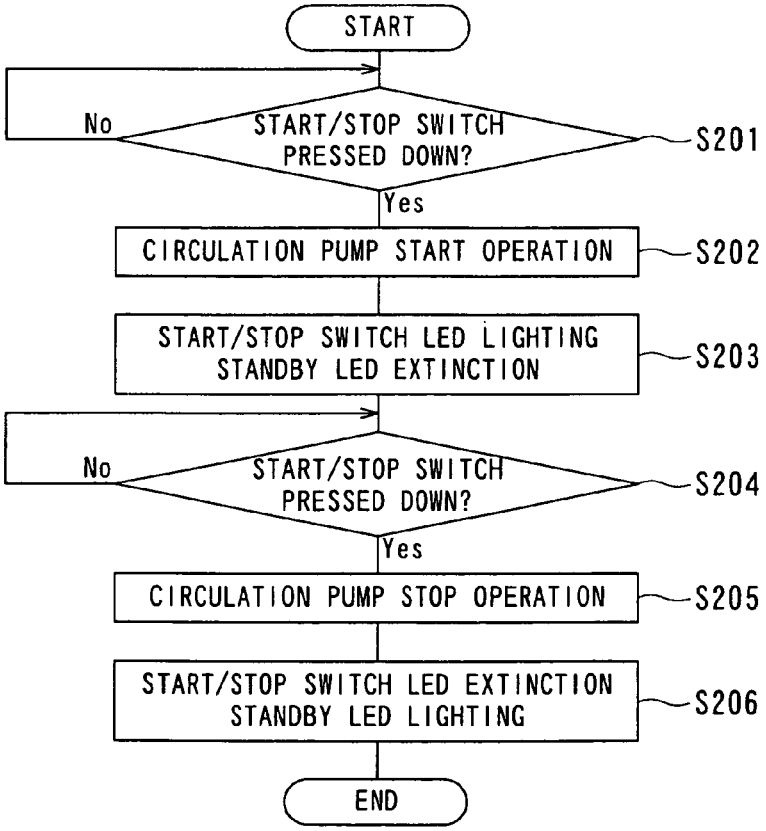
FIG. 36 is a flowchart explaining a flow of water spouting operation.

When feed water preparation is completed, water spouting is ready. FIG. 36 is a flowchart for explaining a flow of water spouting operation. When the user presses down the start/stop switch 172 (Step S201), the signal is sent to the switch driver substrate 153, and the switch driver substrate 153 sends a driving start signal to the circulation pump 134 (Step S202). By this, water spouting operation is started. At this time, if the lower water-level detection sensor is OFF, the water spouting is not started as above.

The switch driver substrate 153 turns off the standby LED 171 with it and lights the LED of the start/stop switch 172 (a circumference portion in FIG. 25, for example) (Step S203).

When the start/stop switch 172 is pressed down again (Step S204), the signal is sent to the switch driver substrate 153, and the switch driver substrate 153 sends a driving stop signal to the circulation pump 134 to stop the circulation pump 134 (Step S205). With it, the switch driver substrate 153 lights the standby LED 171 and turns off the LED of the start/stop switch 172 (Step S206). By this, water spouting is finished.

In this way, every time the start/stop switch 172 is pressed down, the switch driver substrate 153 toggles instructions to start and stop the operation to the circulation pump 134.

Figure 37:
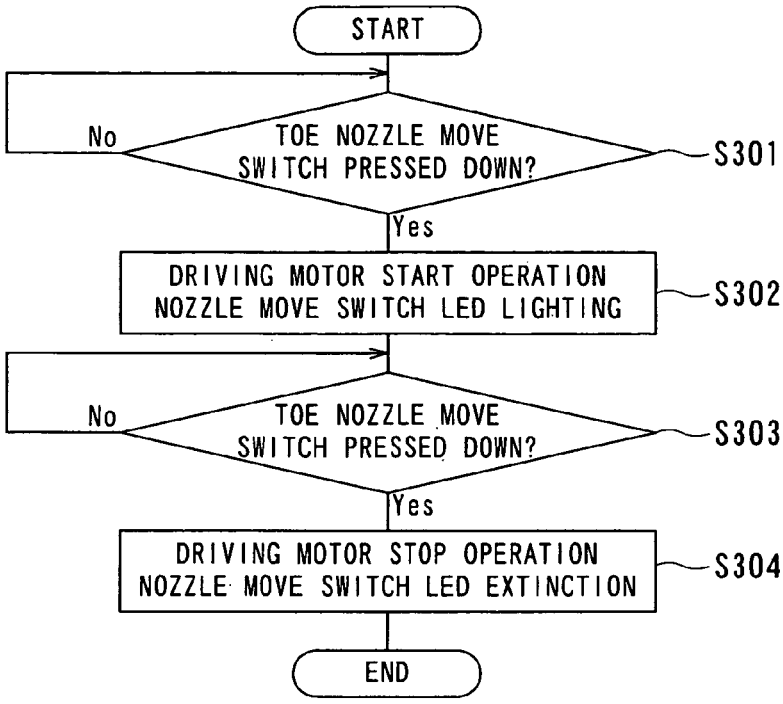
FIG. 37 is a flowchart explaining a flow of rotating operation of the toe nozzle.

The flow to rotate the toe water-spouting nozzle unit 130 is shown in a flowchart in FIG. 37. When the toe nozzle move switch 173 is pressed down by the user (Step S301), the signal is sent to the motor driver substrate 154, and the motor driver substrate 154 sends an operation start signal to the driving motor 150 to start operation of the driving motor 150, and the motor driver substrate 154 lights the LED of the toe nozzle move switch 173 (a nozzle section in FIG. 25, for example) (Step S302). By this, the toe water-spouting nozzle unit 130 starts rotational movement.

Here, when the toe nozzle move switch 173 is pressed down again (Step S303), the signal is sent to the motor driver substrate 154, and the motor driver substrate 154 sends an operation stop signal to the driving motor 150 to stop the driving motor 150, and the motor driver substrate 154 lights the LED of the toe nozzle move switch 173 (Step S304). By this, the toe water-spouting nozzle unit 130 ends the rotational movement.

In this way, every time the toe nozzle move switch 173 is pressed down, the motor driver substrate 154 toggles instructions to start and stop the operation to the driving motor 150.

Figure 38:
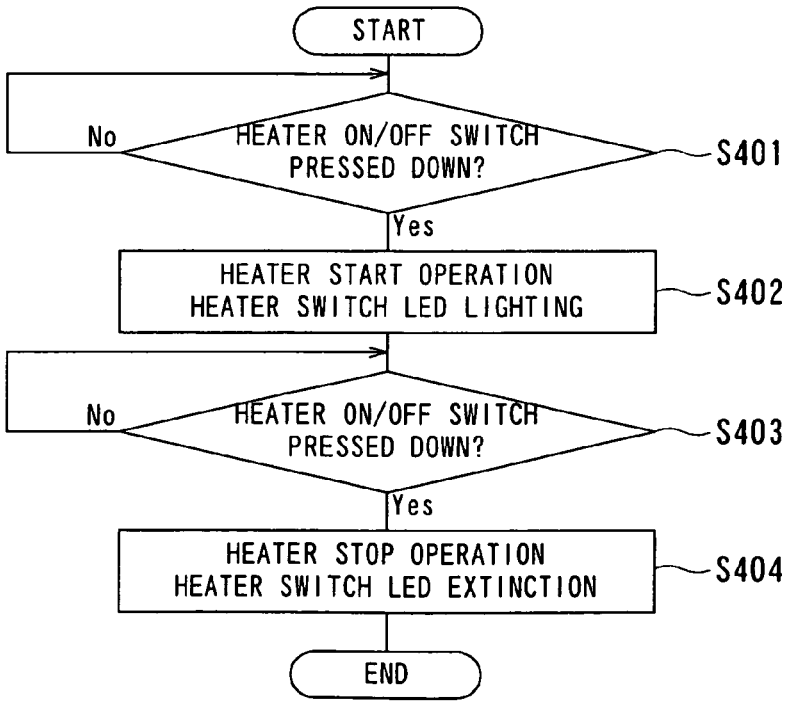
FIG. 38 is a flowchart showing a flow of operation to maintain water temperature of circulating spouting water.

FIG. 38 is a flowchart showing a flow of work to maintain the water temperature of the circulating spouting-water. When the heater ON/OFF switch 174 is pressed down by the user (Step S401), the signal is sent to the heater controller 158, and the heater controller 158 sends an operation start signal to the sheathed heater 155 to start operation of the sheathed heater 155, and the heater controller 158 lights the LED of the heater ON/OFF switch 174 (a wavy line section in FIG. 25, for example) (Step S402). By this, the sheathed heater 155 starts heat generation.

Here, when the heater ON/OFF switch 174 is pressed down again (Step S403), the signal is sent to the heater controller 158, and the heater controller 158 sends an operation stop signal to the sheathed heater 155 to stop operation of the sheathed heater 155 and the controller 158 lights the LED of the foot heater ON/OFF switch 174 (Step S404). By this, the sheathed heater 155 finishes heat generation operation.

In this way, every time the heater ON/OFF switch 174 is pressed down, the heater controller 158 toggles instructions to start and stop heat generation to the sheathed heater 155.

In this flowchart, the case where the heater ON/OFF switch 174 is turned ON/OFF by the user has been described, but it may be so constituted that, when the water temperature in the tank 132 becomes lower than a predetermined temperature, the thermister 157 installed in the tank 132 sends the signal to the heater controller 158, and the heater controller 158, upon receipt of this signal, sends a signal to the sheathed heater 155 to start heat generation.

Moreover, it may be so constituted that the thermister 157 sends a signal to the heater controller 157 when the water temperature in the tank 132 gets higher than the predetermined temperature, and the heater controller 158, upon receipt of this signal, sends a signal to the sheathed heater 155 to stop heat generation. By this, the water temperature can be automatically kept in a certain range.

Figure 39:
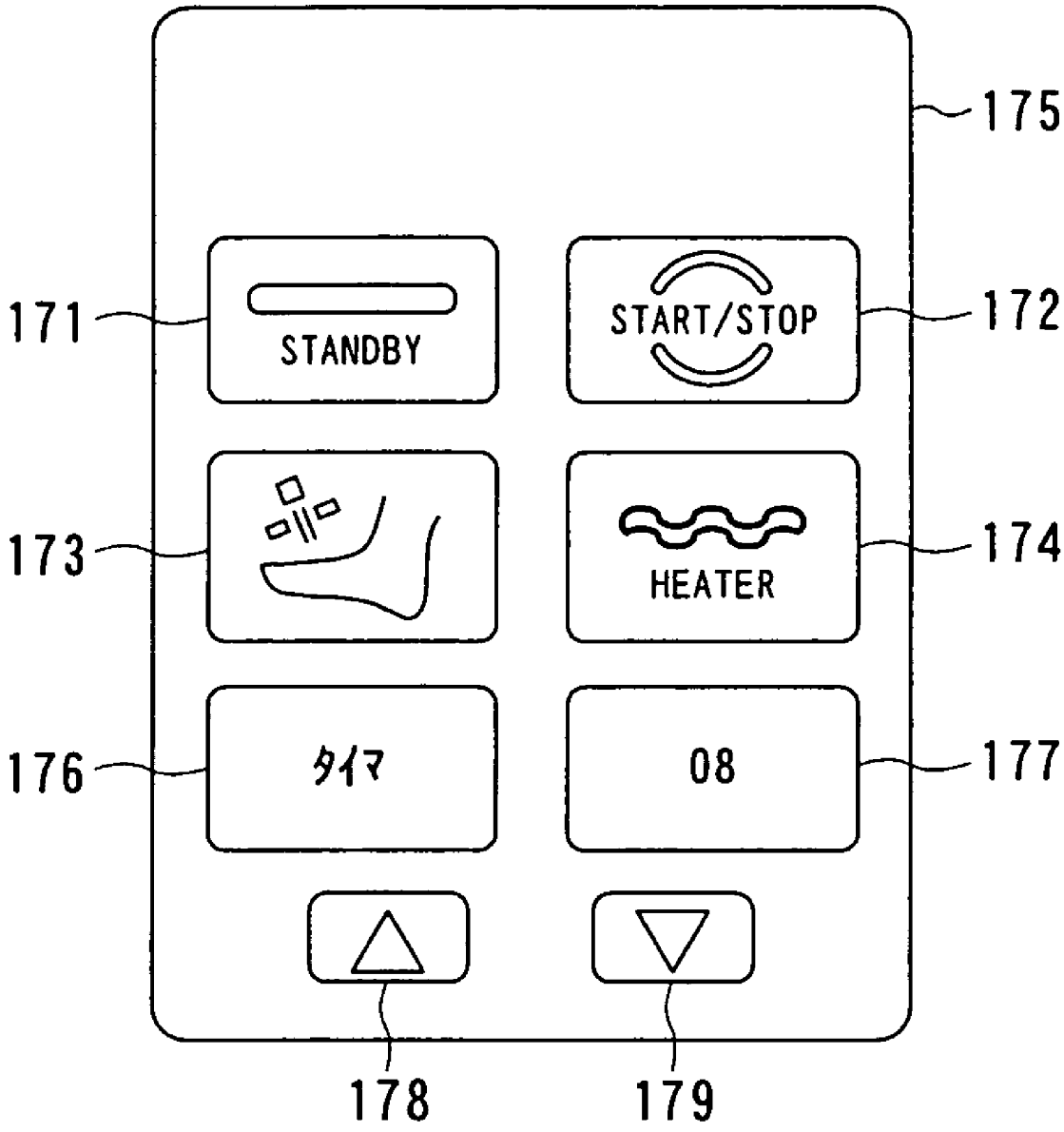
FIG. 39 is a view showing a remote controller of the leg water-spouting device according to the third preferred embodiment.

A variation of this leg water-spouting device 1B will be described below. FIG. 39 shows a remote controller 175 for operating the leg water-spouting device according to this variation. This remote controller 175 is provided instead of the above-mentioned operation panel 170 or in addition to the operation panel 170.

The remote controller 175 is provided with the standby LED 171 provided on the operation panel 170, the start/stop switch 172, the toe nozzle move switch 173 and the heater ON/OFF switch 174 as well as a timer button 176, a digital indication 177, an up button 178 and a down button 179. Here, for the same switches as those provided at the operation panel 170, description will be omitted.

The timer button 176 imparts a timer function to this remote controller 175, and continuous use time can be set by the minute. At shipment from the factory, 15 minutes, for example, is set as a default value.

When the timer button 176 is pressed, the digital indication 177 is flashed indicating the set time. If the continuous use time longer than the indicated is desired to be set, the up button shall be pressed, while if the time is to be made shorter, the down button shall be pressed to make the digital indication 177 indicate a desired time. When the desired time is indicated and the timer button 176 is pressed down again, the indication of the digital indication 177 is changed from flashing to lighting, and setting of the new continuous use time is completed. It is of course possible to provide this timer function to the operation panel 170.

Figure 40:
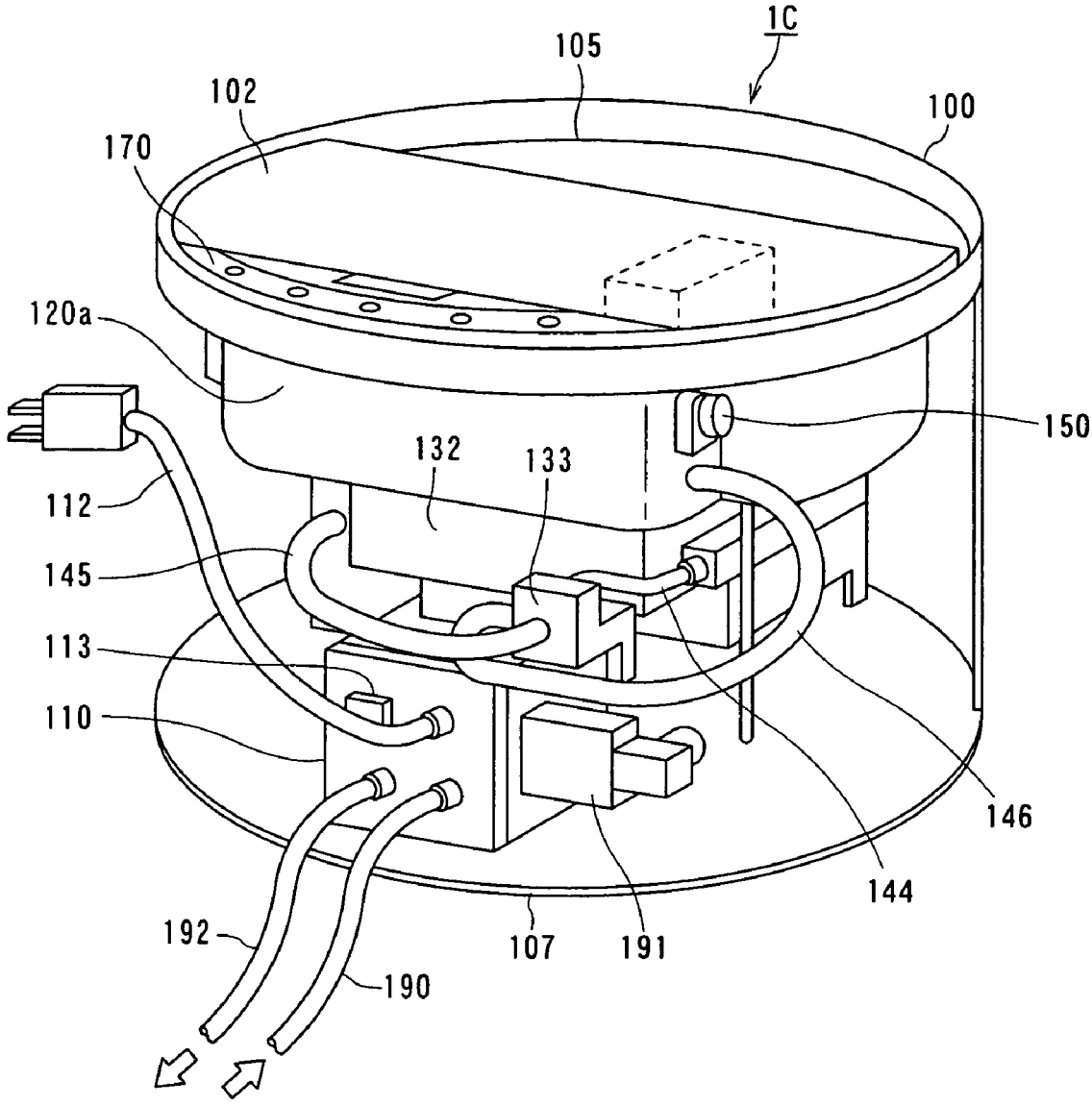
FIG. 40 is a perspective view of a feed-water pipe direct connection method as a variation of the leg water-spouting device according to the third preferred embodiment.

While in the leg water-spouting device 1B according to the third preferred embodiment, water is fed manually by the user and circulated in the container body, a feed water pipe 190 and a drain pipe 192 are directly connected in a variation shown in FIG. 40, and the spouted water is consecutively discharged without circulation, which is the basic difference. The other constructions are substantially the same as that of the third preferred embodiment, and the same reference numerals are given and the description will be omitted.

Since the water is not circulated but fed directly to the water spouting nozzle by the water pressure from the water pipe and spouted, a leg water-spouting device 1C according to this variation does not need a circulation pump any more but is provided with a feed-water electromagnetic valve 191 for controlling opening/closing of the water pipe 190. As the feed-water electromagnetic valve 191, a normal close type in the power-off state is used.

The feed water pipe 190 and the drain pipe 192 are connected to a back-face plate 110 using the one-touch joint, respectively. If they are connected permanently, they may be connected without the one-touch joint.

Also, since water is fed continuously and directly sent to the respective water-spouting nozzles, it is not necessary to pay attention to the reserved water amount in the tank 132, and thus, the water-level detection sensors are not required any more.

Moreover, since the used water is sequentially replaced, maintaining of the water temperature does not make sense and the heater function is not needed any more. In addition, the heater ON/OFF switch 174 on the operation panel 170 is not needed, either. Therefore, if use at a water temperature above a certain level is desired, connection to a feed water pipe capable of supply of hot water at an appropriate temperature is necessary.

In addition, since the feed water pipe 190 is directly connected to the respective water-spouting nozzle pipings through the feed water electromagnetic valve 192, the tank 132 does not have any substantial meaning but only for an unexpected accident such as clogging of the drain pipe 192. In this way, the leg water-spouting device 1C according to this variation has a simple construction as compared with that according to the third preferred embodiment, which can reduce manufacturing costs.

Since the leg water-spouting device 1C of this variation is different from the leg water-spouting device 1B according to the third preferred embodiment as mentioned above, the usage is inevitably different.

First, there is no preparation operation to reserve water in the-tank 132, and when the user connects the power cord 112 to the outlet and turns ON the power switch 113, the standby LED 171 is lighted by the instruction of the switch driver substrate 153. In this variation, the standby LED 171 indicates that the power is ON in this way.

Figure 41:
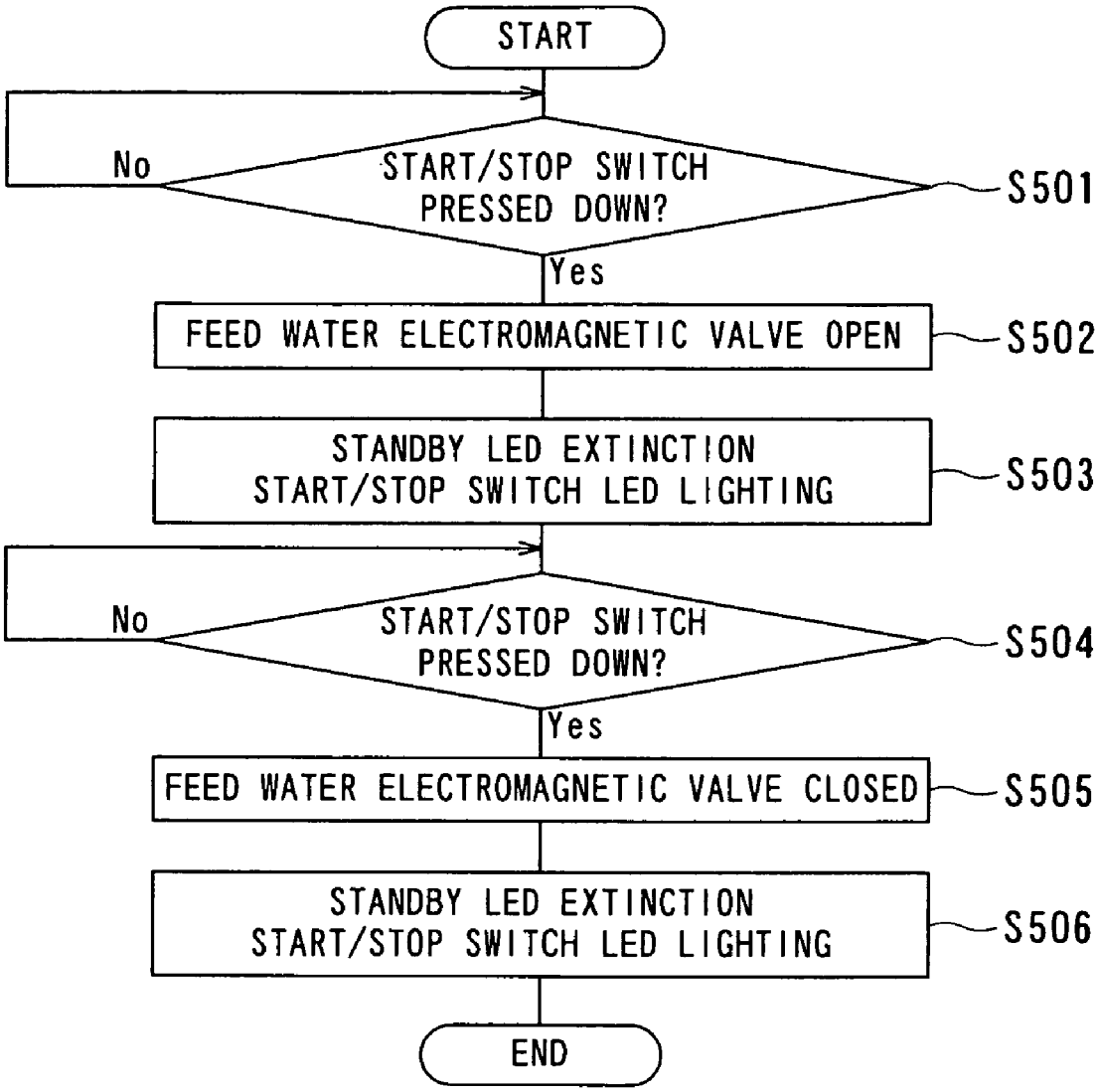
FIG. 41 is a flowchart explaining a flow of water-spouting operation in the variation of the third preferred embodiment.

FIG. 41 is a flowchart for explaining the flow of water spouting operation of this variation. When the user presses down the start/stop switch 172 (Step S501), the signal is sent to the switch driver substrate 153, and the switch driver substrate 153 sends an open signal to the feed water electromagnetic valve 192 (Step S502). By this, inflow of water from the feed water pipe 190 is started and the inflow can be sent directly to the respective nozzles by the water pressure.

The switch driver substrate 153 lights the standby LED 171 with it and also turns off the LED of the start/stop switch 172 (Step S503).

Here, when the start/stop switch 172 is pressed down again (Step S504), the signal is sent to the switch driver substrate 153, and the switch driver substrate 153 sends a close signal to the feed water electromagnetic valve 192 to close the feed water electromagnetic valve 192 (Step S505). With that, the switch driver substrate 153 lights the standby LED 171 and turns off the LED of the start/stop switch 172 (Step S506). By this, the water spouting operation is finished.

In this way, every time the start/stop switch 172 is pressed down, the switch driver substrate 153 toggles instructions to open and close the feed water electromagnetic valve 192.

On the other hand, the flow to rotationally move the toe water-spouting nozzle unit 130 is totally the same as that according to the third preferred embodiment, and the work to maintain the temperature of spouting water is not performed to the contrary.

The above-described preferred embodiment is for explanation and does not limit the scope of the present invention. Therefore, those skilled in the art can employ a preferred embodiment in which a part or the whole of these elements are substituted by equivalents, but those preferred embodiments are also included in the scope of the present invention.

Figure 21:
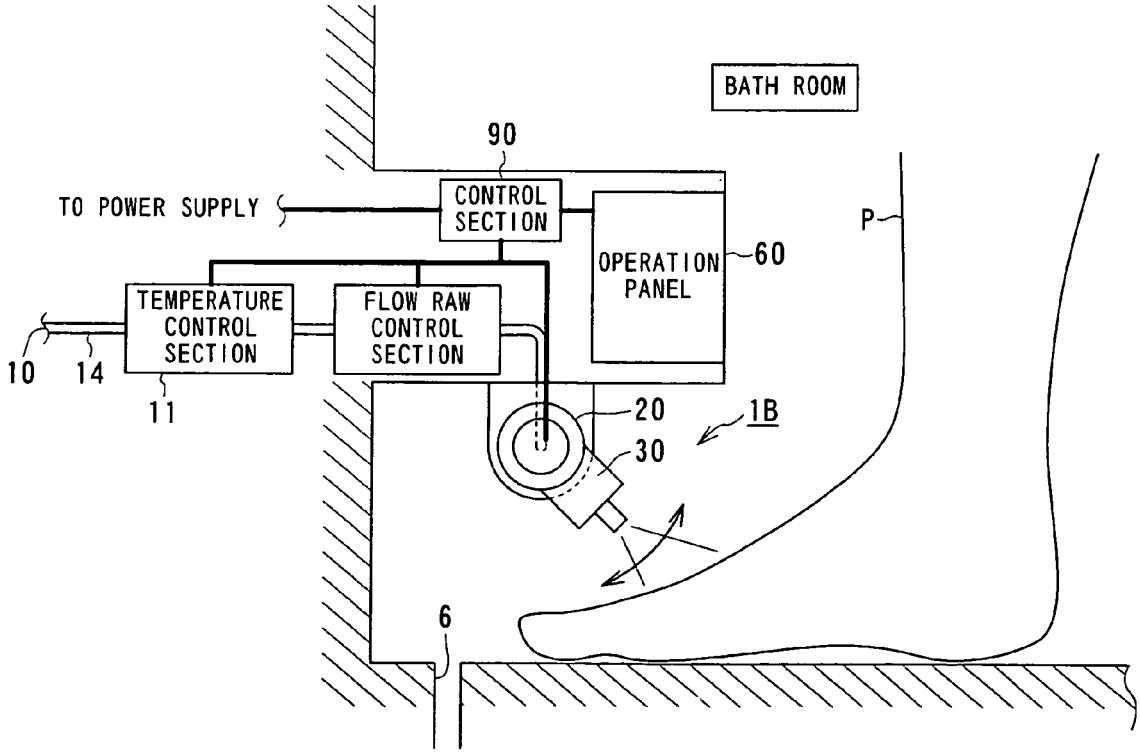
FIG. 21 is a view showing an example of the leg water-spouting device integrally incorporated in a bath room.
Figure 22A:
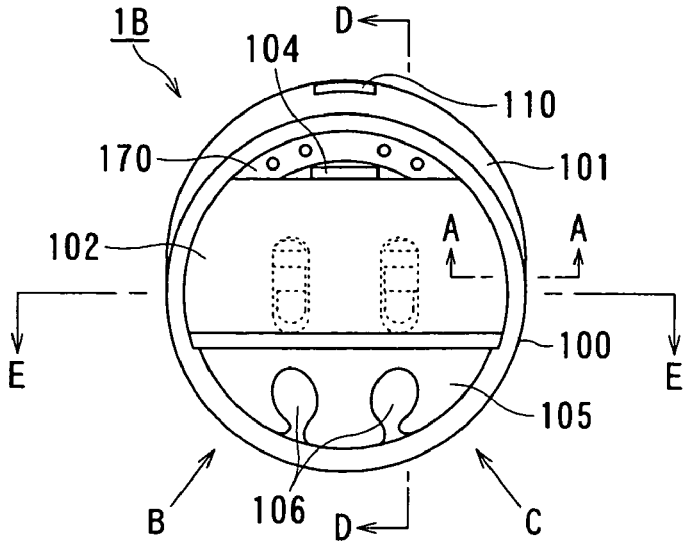
FIG. 22A is a plan view.
Figure 22B:
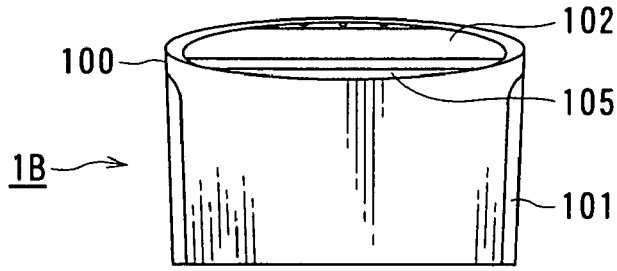
FIG. 22B is a front view.
Figure 22C:
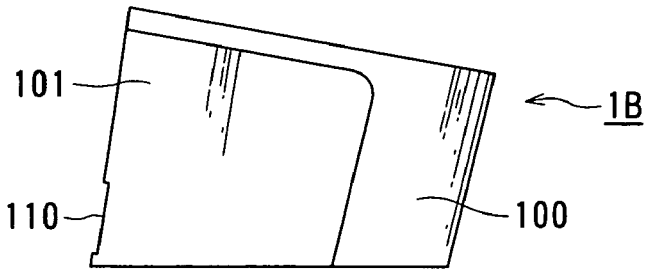
FIG. 22C is a left side view.
Figure 22D:
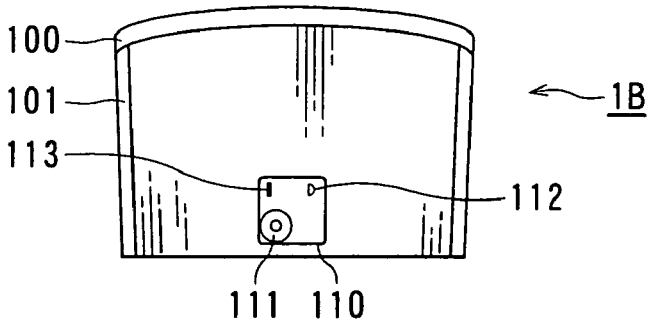
FIG. 22D is a rear view.

In the above preferred embodiments, an example was described in which the container body 2 for accommodating the foot of the user is provided and the user P has the foot accommodated inside this container body 2 to receive water spouting. However, it may be so constituted that the container body 2 is not provided but the foot-front nozzle water-spouting section 30 is integrally incorporated in a bathroom under a counter 90 provided inside the bathroom or the like through the water-spouting section direction moving mechanism 20 as shown in FIG. 21, for example. In this example, the foot-front nozzle 30 and the water-spouting section direction moving mechanism 20 are mounted with their both ends held between two holding fixtures 91, 91 suspended on the lower face of the counter 90.

INDUSTRIAL APPLICABILITY

As mentioned above, according to the leg water-spouting device according to the present invention, the sensory receptors existing on the skin are effectively stimulated so that greater comfort can be obtained.

What is claimed is:

1. A foot water-spouting device comprising:

a foot-front water spouting section configured to spout water toward a top front area of a user's foot;

a water-spouting section direction moving mechanism configured to move the direction of water spouting of the foot-front water spouting section along a longitudinal direction of the top-front area of the user's foot; and a control section for controlling the water-spouting section direction moving mechanism;

wherein said foot-front water spouting section has a plurality of water-spouting nozzles arranged side-by-side in the foot width direction for each of the right and left foot and said foot-front water-spouting section is configured to continuously spout water with a spouting first dimension causing only a part of the foot in a longitudinal direction to receive spouted water while the combined spouting width of the side-by-side nozzles extends across the width of the foot in a second dimension that is greater than said first dimension;

said water-spouting section direction moving mechanism being configured so as to concurrently move the plurality of side-by-side water-spouting nozzles in the longitudinal foot direction, whereby the spouted water across the width of the foot is moved along a longitudinal direction of the foot; and said control section being configured to control the water-spouting section direction moving mechanism such that water spouted from the plurality of the water-spouting nozzles is sequentially passed over a longitudinal dimension of the foot ranging from a toe side to an ankle side, thereby only intermittently spouting water onto different top-foot areas.

2. The foot water-spouting device as in claim 1, wherein a path of movement of a water arrival point receiving the spouting water by the water-spouting section direction moving mechanism includes a toe.

3. The foot water-spouting device as in claim 1, wherein the control section controls changes in pressure of spouting water received by the water arrival point according to position of the water arrival point.

4. The foot water-spouting device as in claim 2, wherein the control section controls pressure of spouting water received by the water arrival point to be highest when the water arrival point is at the toe.

5. The foot water-spouting device as in claim 1, wherein the control section comprises a flow rate control section which is configured to change a water spouting flow amount according to a position of the moving water arrival point.

6. The foot water-spouting device as in claim 5, wherein the control section controls the flow rate control section to cause the largest flow rate of spouted water when the water arrival point is located at the toe.

7. The foot water-spouting device as in claim 1, wherein the water-spouting section direction moving mechanism comprises a rotary shaft that pivotally supports either rotation or rotational movement of the foot-front water spouting section as the water arrival point is moved along a longitudinal direction of the foot.

8. The foot water-spouting device as in claim 7, wherein the rotary shaft is pivotally supported immediately above a position of root of the fifth toe or closer to the toe tip side from that in the container body in use.

9. The foot water-spouting device as in claim 1, wherein the control section controls the water-spouting section direction moving mechanism to reciprocate a water arrival point along a longitudinal direction of the foot.

10. The foot water-spouting device as in claim 1, wherein the foot water-spouting device further comprises a sole water spouting section configured to spout water toward a sole of a user's foot.

11. The foot water-spouting device as in claim 10, wherein the control section controls at least one of a water spouting amount and a water spouting pressure of the sole water spouting section by effecting cyclical changes.

12. The foot water-spouting device as in claim 11, wherein the control section controls the water-spouting section direction moving mechanism to cause a direction of water spouted from the foot-front water spouting section to be cyclically oscillated.

13. The foot water-spouting device as in claim 10, wherein the control section controls the sole water spouting section to cause the direction of water spouted from the sole water spouting direction to be cyclically oscillated.

* * * * *